United States Patent [19]

Murata et al.

[11] Patent Number: 4,928,563

[45] Date of Patent: May 29, 1990

[54] ELECTRONIC TUNING APPARATUS FOR AN ELECTRONIC STRINGED MUSICAL INSTRUMENT

[75] Inventors: Yoshiyuki Murata, Tachikawa; Hajime Manabe, Higashiyamato, both of Japan

[73] Assignee: Casio Computer Co., Ltd., Tokyo, Japan

[21] Appl. No.: 290,981

[22] Filed: Dec. 28, 1988

[30] Foreign Application Priority Data

Dec. 31, 1987 [JP] Japan ..... 62-332196
Oct. 20, 1988 [JP] Japan ..... 62-262919

[51] Int. Cl.[5] ..... G10G 7/02; G10H 3/18

[52] U.S. Cl. ..... 84/726; 84/454; 84/DIG. 18; 324/78 D

[58] Field of Search ..... 84/1.01, 1.14–1.18, 84/1.25, 453, 454, DIG. 7, DIG. 18, DIG. 30; 324/78 R, 78 D, 78 E, 79 R, 79 D, 80, 81, 83 R, 83 D

[56] References Cited

U.S. PATENT DOCUMENTS 4,429,609 2/1984 Warrender ..... 84/454
4,497,236 2/1985 Rose .
4,688,464 8/1987 Gibson et al. ..... 84/454

*Primary Examiner*—Stanley J. Witkowski
*Attorney, Agent, or Firm*—Frishauf, Holtz, Goodman & Woodward

[57] ABSTRACT

In an electronic tuning apparatus used in electronic stringed instruments such as an electronic guitar, an electronic violin, and so on, at least one string is extended along the fingerboard. Prior to picking performance, a present state of the extended string is examined through picking said string. Preferably, a reference pitch data extracted through the string-picking manipulation is stored. During a live picking performance, a performance-pitch data extracted is converted into a data for defining a properly-tuned sound-frequency in accordance with said extended string state. A musical-tone having a corresponding sound frequency is generated based on data for defining said sound frequency.

47 Claims, 29 Drawing Sheets

| ADDRESS | X CENT | Y PERIOD (DATA) |
|---|---|---|
| 0 | 0 ZERO FRET | 1000.00 |
| 1 | 10 (OPEN-STRING FRET) | 994.24 |
| 2 | 20 | 988.51 |
| 3 | 30 | 982.82 |
| 4 | 40 | 977.15 |
| 5 | 50 | 971.53 |
| 6 | 60 | 965.93 |
| 7 | 70 | 960.37 |
| 8 | 80 | 954.84 |
| 9 | 90 | 949.34 |
| 10 | 100 (1ST FRET) | 943.87 |
| 11 | 110 | 938.43 |
| 12 | 120 | 933.03 |
| ⋮ | ⋮ | ⋮ |
| 20 | 200 (2ND FRET) | 890.89 |
| 21 | 210 | 885.76 |
| 22 | 220 | 880.66 |
| ⋮ | ⋮ | ⋮ |
| 25 | 250 | 865.53 |
| ⋮ | ⋮ | ⋮ |
| 30 | 300 (3RD FRET) | 840.89 |
| ⋮ | ⋮ | ⋮ |
| 60 | 600 | 707.10 |
| ⋮ | ⋮ | ⋮ |
| 120 | 1200 | 500.00 |
| ⋮ | ⋮ | ⋮ |
| 180 | 1800 | 353.55 |
| ⋮ | ⋮ | ⋮ |
| 240 | 2400 (24TH FRET) | 250.00 |
| 241 | 2410 | 248.56 |
| 242 | 2420 | 247.12 |
| ⋮ | ⋮ | ⋮ |
| 250 | 2500 | 235.96 |
| ⋮ | ⋮ | ⋮ |
| 260 | 2600 | 222.72 |
| ⋮ | ⋮ | ⋮ |
| 270 | 2700 | 210.22 |
| ⋮ | ⋮ | ⋮ |
| 280 | 2800 (28TH FRET) | 198.42 |

FIG. 22

OPEN-STRING KEY-CODE

| STRING | KEY CODE (10 CENT UNIT) | | MUSICAL TONE |
|---|---|---|---|
| 1ST STRING | 520 | 12a | E4 |
| 2ND STRING | 470 | 12b | B3 |
| 3RD STRING | 430 | 12c | G3 |
| 4TH STRING | 380 | 12d | D3 |
| 5TH STRING | 330 | 12e | A2 |
| 6TH STRING | 280 | 12f | E2 |

FORMAT

| | PERIOD ( μsec ) |
|---|---|
| 1ST STRING | 3034 |
| 2ND STRING | 4050 |
| 3RD STRING | 5102 |
| 4TH STRING | 6811 |
| 5TH STRING | 9091 |
| 6TH STRING | 12135 |

16

ELECTRONIC TUNING APPARATUS FOR AN ELECTRONIC STRINGED MUSICAL INSTRUMENT

BACKGROUND OF THE INVENTION

1. Field of the Invention

The present invention relates generally to an electronic tuning apparatus used in electronic stringed instruments of a plucked instrument type (e.g., a guitar, bass) and of a bowed instrument type (e.g., a violin), and more particularly, to an electronic tuning apparatus capable of obtaining musical tones having a proper sound frequency which are the same as those obtained by plucking properly tuned strings, depending upon an electronic string tuning method but not upon a mechanical string tuning method.

2. Description of the Related Art

Recently, with a rapid development of electronic technology, various types of electronic stringed instruments have been developed, which employ electronic technique, such as for instance electric guitars, electronic violins, guitar synthesizers and so on. These newly developed stringed instruments have been proposed in place of traditional acoustic stringed instruments, such as Oriental Koto, Indian sitar, violin, guitar and the like.

This electronic stringed instrument is clearly different from the acoustic stringed instrument mentioned above, in its sound-generation mechanism in which a vibration of an extended string is converted into an electric signal and a sound is generated with a desired tone color and sound volume in accordance with said converted electric signal. The electronic stringed instrument, however, has a feature similar to that of the acoustic instrument. That is, in the electric stringed instrument, as in the acoustic instrument, strings are extended with a predetermined tension along the string-depression board (i.e., a fingerboard) and an effective string length for vibration is defined by depressing the string at a predetermined fret position with a finger, wherein a musical tone of a sound frequency defined by the fret position is generated by plucking the depressed string. Accordingly, it is required in the electronic stringed instrument, as in the acoustic stringed instrument, that all of the individual strings must be extended with a proper tension, respectively, and each of the strings is extended along the fingerboard with a proper strings length, relative to the fret positions fixedly aligned on said fingerboard. That is, each of the strings must be extended under proper tuning conditions as stated above. A string which is extended with an improper tension and is extended for a distance of an improper string length relative to the fret position may result in a generation of a musical tone of an incorrect sound frequency. In particular, in a guitar synthesizer of a type in which musical tones of various tone colors are generated by a string plucking operation, a string-vibration pitch-information defined by an effective vibration length of a string is extracted, and a generation of a musical tone having a corresponding sound frequency is controlled in accordance with said extracted string-vibration pitch-information, so that, if each of the strings is not extended under proper tuning conditions, an incorrect string-vibration pitch-information is extracted, which results in generating a musical tone of an incorrect sound frequency. Accordingly, each of the strings specially needs to be extended under a proper tuning state.

It is known to those skilled in the art that there are two types of string tuning in which a string is properly tuned. One type of tuning is referred to as a pitch or fine tuning method, in which a tensile strength on an extended string is increased or decreased by a manipulation of bobbin devices (referred to as pegs) mounted on the head of the stringed instrument, thereby the tension on the extended string being controlled. The other type of string tuning is referred to as a harmonic or string length tuning method, in which the length of the string is varied by altering the distance between a pair of the string supports (generally referred to as a bridge, nuts) which support both the ends of the extended string.

In the meantime, a novel tuning apparatus has been developed, which is disclosed in U.S. Pat. No. 4,497,236, and which is capable of accomplishing both the sring tunings in accordance with both the methods stated above almost at the same time. The tuning apparatus has been developed to overcome disadvantages that when the tension on the string and the string length are to be corrected in accordance with the conventional method, the string tension control mechanism and the string length control mechanism must be independently manipulated to set the proper tuning state, which requires troublesome and time consuming tuning work. By the tuning apparatus, the tension on each of the strings can be increased or decreased, while each of the strings is firmly restrained at its one end after the length of the string is properly set, that is, without changing the string lengths which have been properly set, so that the tuning apparatus permits obtaining the proper tuning state relatively easily and rapidly compared with the conventional tuning apparatus.

Even in the event of setting the proper tuning state by the use of the tuning apparatus mentioned above, there are still disadvantages that the mechanical tuning work is required, such as fine adjustment work for tension control member and the string supported member, and moving these members in the direction of the neck of the stringed instrument.

Even in the case, each of the strings is tuned in proper conditions before performance, frequent operations during the performance can often result in a disturbed tuning condition for the strings, such as arming operations by a tremolo arm (operation to modulate musical tones by evenly raising and/or lowering their sound frequency), bending operations with a finger (operation to raise and/or lower the sound frequency of the generated musical tone by transversely moving the depressed string after picking the string), sliding operation (operation t modulate the sound frequency of the generated musical tone after picking the string by sliding the finger depressing the string longitudinally along the string). If this unfavorable problem is occurring , it is hard to immediately readjust the instrument to a proper tuning condition during the short interval up to the following performance, and consequently, there is still another disadvantage that the player cannot help continuing to play the instrument with unintentional sound frequencies.

Furthermore, it is difficult for a beginner to adjust to the proper tuning condition for each of the strings and the beginner often extends the string with an excess tension, resulting in breaking the string. There is still one more disadvantage that in order to prevent from occurring the situation mentioned above, professional work must be asked for a string tuning operation and/or help of other tuning instrument is especially needed.

SUMMARY OF THE INVENTION

It is an object of the present invention to provide an electronic tuning apparatus in which, even in the event a string is not properly tuned, a simple initial tuning operation permits generating a musical tone of a precise sound frequency similar to the case of a plunking operation of a properly tuned string.

It is another object of the present invention to provide an electronic tuning apparatus capable of sound frequency controlling to tune a string following operations which change vibration frequency of the string, such as the sliding operation, bending operation, arming operation, and so on.

The present invention provides an electric tuning apparatus in which a pitch-information extracted by plucking each of the strings with the corresponding string being depressed at a particular reference fret-position is previously set as a reference pitch-information before a performance, and a performance pitch-information is extracted by plucking the string with the corresponding string being depressed at an arbitrary fret position during the performance, thereby permitting generation of a musical tone, the sound frequency of which is defined in accordance with both said performance pitch-information and said reference pitch-information.

The present invention also provides an electronic tuning apparatus in which a string extension condition as a reference which affects a string tuning is discriminated and confirmed before a performance on the basis of a fundamental period of a string-vibration extracted by a pitch-extracting means from a plucked string which is depressed at a predetermined position, and at instructing an initiation of a sound generation, an initial sound frequency is controlled by converting the fundamental period extracted by the pitch-extracting means into a sound-defining data tuned on the basis of the result of said discrimination of the string-extension condition, and when a new fundamental period is extracted by the pitch-extracting means after instructing the initiation of sound generation, the period is converted into the sound-frequency defining data tuned on basis of the result of the discrimination of the string-extension condition, thereby controlling an after sound frequency.

In one arrangement of the invention, in the first place before the performance, the player plucks each of the strings with the corresponding string being depressed at a particular reference fret position (e.g., open string fret position or the 24th fret position), whereby the reference-pitch information extracted by the pitch-extracting means is previously set by the reference-pitch information setting means. Then, during the actual performance, electronic operations are executed in the sound-frequency defining control means, based on both the reference-pitch information pre-set as mentioned above and a performance-pitch information, thereby obtaining the corresponding sound-frequency defining information [e.g., key-code data or fret-number data (hereinafter, referred to as key code)]. The above mentioned performance-pitch information is obtained by extracting by means of the pitch-extracting means from the plucked string, with the strings being depressed at arbitary fret positions. A musical tone having a sound frequency defined based on the sound-frequency information is generated from a musical-tone generating means.

The initial setting operation in this arrangement is very simply accomplished by the player's string plucking operation with the string being depressed at a particular reference fret position and by the initial setting of the extracted pitch-information corresponding to the reference fret-position into the reference pitch-setting means. After the initial setting operation has been finished, when the string is actually plucked, the electrical tuning functions so as to produce a musical tone having a proper sound-frequency based on both the performance-pitch information and the above mentioned reference-pitch information. Therefore, mechanical tuning operation is not needed at all. In case the tuning state is disturbed during performance as a result of the loose to the extended string, only the same initial setting operation is required. The electronic stringed instrument of the electronic tuning type is available, in which the proper tuning is immediately achieved with an extremely easy tuning operation.

The present invention permits generation of musical tones having the sound frequency in a proper tuning state based upon the reference-pitch information and the performance-pitch information, regardless of the tension on the extended string and/or the length of the extended string. Hence, the present invention is effective in providing an electronic stringed instrument which allows the usage of a plurality of strings to be extended, all of which have the same quality or the same diameter.

In another arrangement of the present invention, each of the strings is depressed at a predetermined depression position and plucked, and then on the basis of a fundamental period of a string vibration, which is extracted by a pitch-extracting means, a string-extended state, as a reference relating to string tuning is discriminated and confirmed by use of a string-state discriminating means. At instructing of initiation of sound generation, or at a string-plucking operation, the fundamental period extracted by th pitch-extracting means is converted into a sound-frequency defining data which is tuned on the basis of the result of the discrimination of the string-state by the string-state discriminating means, thereby controlling the initial sound frequency of a musical tone. After instructing of initiation of sound generation, when an operation, such as a bending operation, sliding operation, and/or an arming operation is performed, which changes a vibration frequency of a string, or when a new fundamental period is extracted by the pitch-extracting means, the new fundamental period is converted in response to this into a sound-frequency defining data tuned on the basis of the discrimination result of the string state, thereby controlling the after sound frequency.

In this arrangement, not only at a plucking operation, but after generation of musical tones by the plucking operation, a musical-tone control can be performed with the automatically tuned sound frequency. In this case, if the sound-frequency defining data generated after the initiation of musical-tone generation has a resolution higher than the sound-frequency defining data generated at the initiation of musical-tone generation, the sound-frequency control can be effected, which follows the fine variation in the string-vibration frequency caused by a bending operation and/or arming operation.

The other arrangement of the present invention comprises a string-state confirming means, an initial sound-frequency control means, an after sound-frequency control means, and also a transform table for transforming the fundamental period of a string extracted by a pitch extracting means into a key code represented by a predetermined transforming function in order to compress a sound-frequency defining data controlled by said initial and after sound-frequency control means, wherein in case the key code is generated by the initial and after sound-frequency control means with reference to the transforming table, a data transmission to means (a sound source means) utilizing the key code can be easily and rapidly effected.

Furthermore, another arrangement has a merit that it requires no logarithm table means, in case that the key code representing a sound-frequency in a given logarithmic function of the period, is used as the above-mentioned sound-frequency defining data, and the key code tuned by the initial and after sound-frequency control means is directly calculated.

In one another arrangement, the key code which represents the sound frequency in terms of frequency is used as the above mentioned sound-frequency defining data, so that key code/frequency conversion is not required in a phase-generating section of the sound source means, resulting in a simple construction for the sound source means.

BRIEF DESCRIPTION OF THE DRAWINGS

FIG. 22 is a table showing string-depression positions vs. contents of period-table memory shown in FIG. 21;

DETAILED DESCRIPTION OF THE PREFERRED EMBODIMENTS

Embodiments of the present invention will be described hereinafter, referring to the accompanying drawings.

First Embodiment

Whole External Construction

Figure 1:
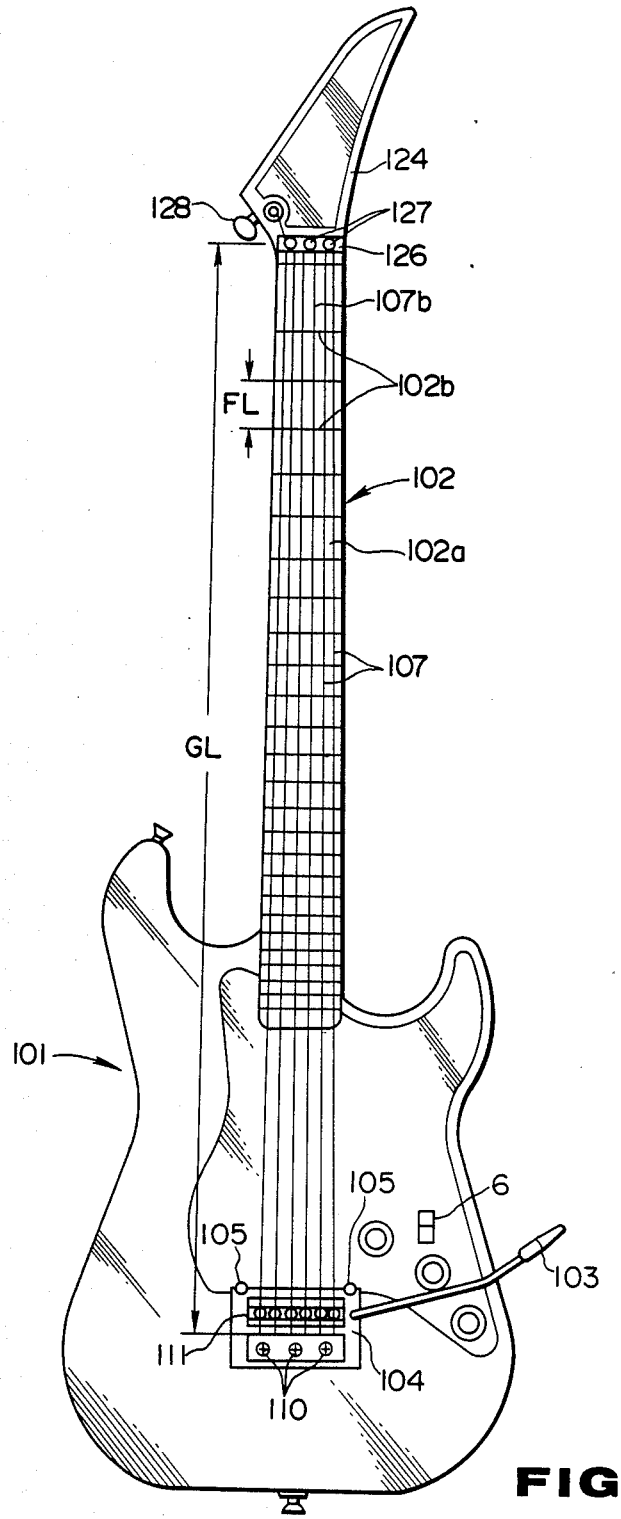
FIG. 1 is a plan view of the first embodiment of the present invention.
Figure 2:
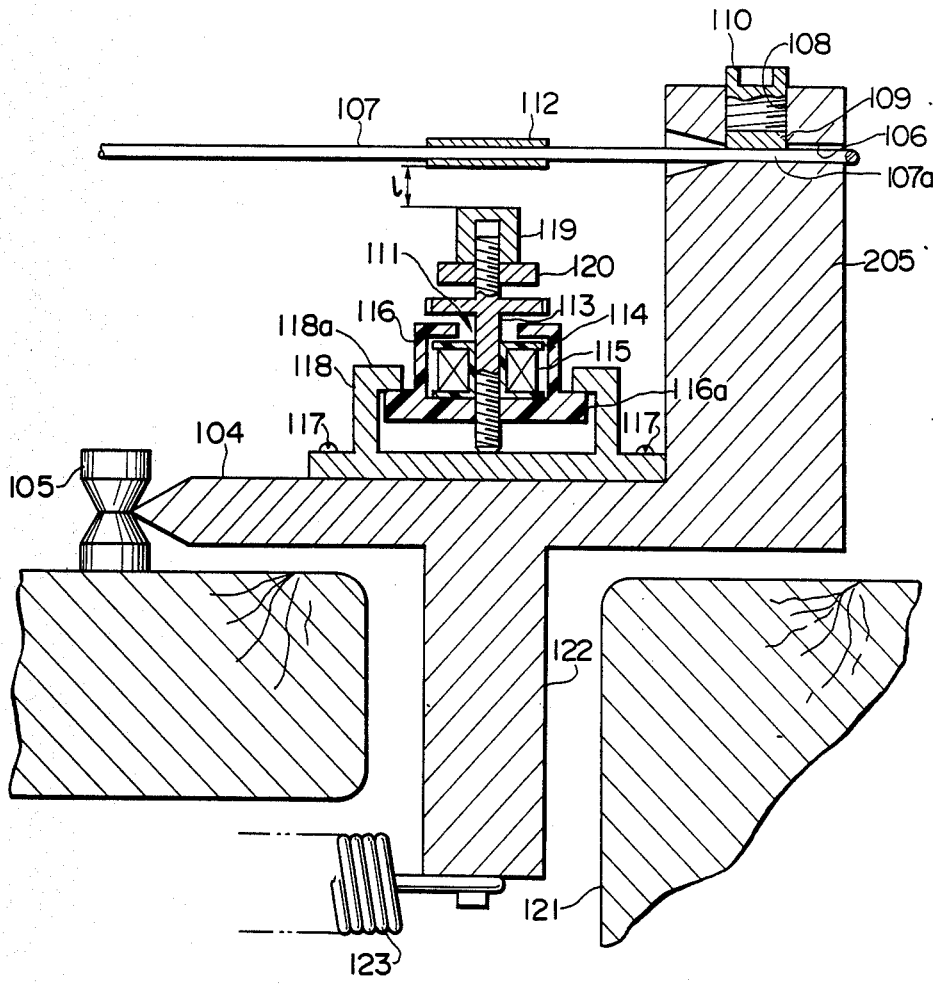
FIG. 2 is a sectional view of part of a string supporting portion of the first embodiment of the invention.

FIG. 1 and FIG. 2 show the first embodiment of the present invention applied in an electronic stringed instrument in which frets are disposed at uneven distances therebetween and each of the strings is extended with a proper length, as in conventional stringed instruments. FIG. 1 is a view showing an external construction of an electronic stringed instrument employing the first embodiment of the invention. FIG. 2 is a sectional view showing an essential part of the string-supporting portion of the electronic stringed instrument.

As shown in FIG. 1, the electronic stringed instrument comprises mainly a body 101, and a neck 102 having a fingerboard 102*a*. A number of frets 102*b* (24 frets in the present embodiment) are disposed on the fingerboard 102*a* at uneven intervals therebetween according to the twelve mean order, namely the frets are aligned at fret distances FL which decrease gradually as the distance from the head 124 toward the body 101 increases. A tremolo base 104 having a tremolo arm 103 is rotatably mounted on the body 101 about fulcrum shafts 105. On the base plate 104 is formed in a unit a string-supporting portion 205, in which six through holes 106 are formed in the direction of the length of the neck 102, as shown in FIG. 2. One string 107A, for instance, of nylon is successively threaded through these through holes 106, resulting in six strings. In the upper portion of the through holes 106 are formed three screw holes 108, in which a string-retaining plate 109 retaining the end 107*a* of each string 107 and a string-retaining screw 110 are accommodated. Tighting the string-retaining screw 110 thrusts down the string-retaining plate 109, thereby firmly fixing the end 107*a* of each string onto the string-supporting portion 205. Pick-up members 111 of an independent type are mounted on the vicinity of the central portion of the tremolo-base plate 104. The pick up member 111 serves to detect a pick-up signal magnetically induced in accordance with a vibration of a magnetic body 112. The magnetic body 112 is made of a sleeve shape member and is provided in unison on the vicinity of the end 107*a* of each string 107, therefore the magnetic body 112 vibrates in unison with the string, when the string vibrates. The pick-up member 111 comprises a securing screw 113 which serves as a core, and a coil 115 wound around a coil bobbin 114, through which the screw 113 extends. The securing screw 113 is secured to the vicinity of the central portion of the disc-shaped pick-up member 11 and the coil 115 is accommodated in a pick-up housing 116. The pick-up housing 116 is formed with a flange portion 116*a* at its peripheral wall which engages with a stop projection 118*a* of a pair of guide plates 118. The guide plates 118 are secured on the tremolo-base plate 104 by screws 117.

The pick-up housing 116 is movably mounted longitudinally along a pair of the guide plates 118 (right and left direction as viewed in FIG. 1). When each fixing screw 113 is not positioned right under the each magnetic body 112, each pick-up housing 116 is appropriately moved longitudinally along the guide plates 118 to position and each screw 113 is tightened, whereby the flange portion 116*a* of the pick-up housing 116 and the stop projection 118*a* of the guide plate 118 are brought into engagement with each other and thus each securing screw 113 can be fixed right under each magnetic body 112.

A cup 119 is screwed onto the head portion of each securing screw 113 for adjusting the clearance between the cup 119 itself and the magnetic body 112. The variation in the magnetic sensitivity between each magnetic body 112 and the corresponding pick-up member 111 can be adjusted by appropriately setting the clearance l.

A retaining ring 120 is screwed onto the securing screw 113 at lower position than the cap 119 for retaining the cap 119 at a predetermined position.

The tremolo-base plate 104 is formed at the central portion of its under surface with an under projection 122, which extends into a through hole 121 in the body 101. One end of a floating spring 123 is engaged with the under projection 122. The spring 123 urges the tremolo-base plate 104 to rotate in a clockwise direction about the shaft 105 as the fulcrum, as seen in FIG. 2.

As shown in FIG. 1, the neck is formed at its extreme end with a head 124. At one end of the neck 124 is provided a string-supporting portion 126 similar to the string-supporting portion 205. And the string-supporting portion 126 is provided with string-fixing screws 127 for fixing the base ends 107*b* of the string 107. The one end of one string 107 is held at the base portion of the string supporting 126 and the other end is wound about a peg 128 rotatably mounted on the head 124. Therefore, a rotating operation of the peg 128 before fixing each of string ends 107*a*, 107*b* at the string-supporting portions 126, 205, permits each of the strings 107 to be expanded evenly under a uniform tension, because the strings 107 consists of one and same string 107A.

Distances (hereinafter, referred as a "string-length distance GL") between supporting points of the string-supporting portions 126, 205 are set to a precise length relative to the fret positions 102*b*. Accordingly, each string 107 is extended with a precise length and the string-length distance GL. This string-length distance GL corresponds to an effective string-vibration length, with which the open string 107 actually vibrates. The string 107, in this embodiment is made of nylon so that the string can be depressed with a relatively low depression force. The magnetic body 112 is fixed at a predetermined position on the nylon string 107, but if the whole of the string 107 is made of metal material (magnetic material), the magnetic body 112 can be omitted.

Whole Circuit Arrangement

Figure 3:
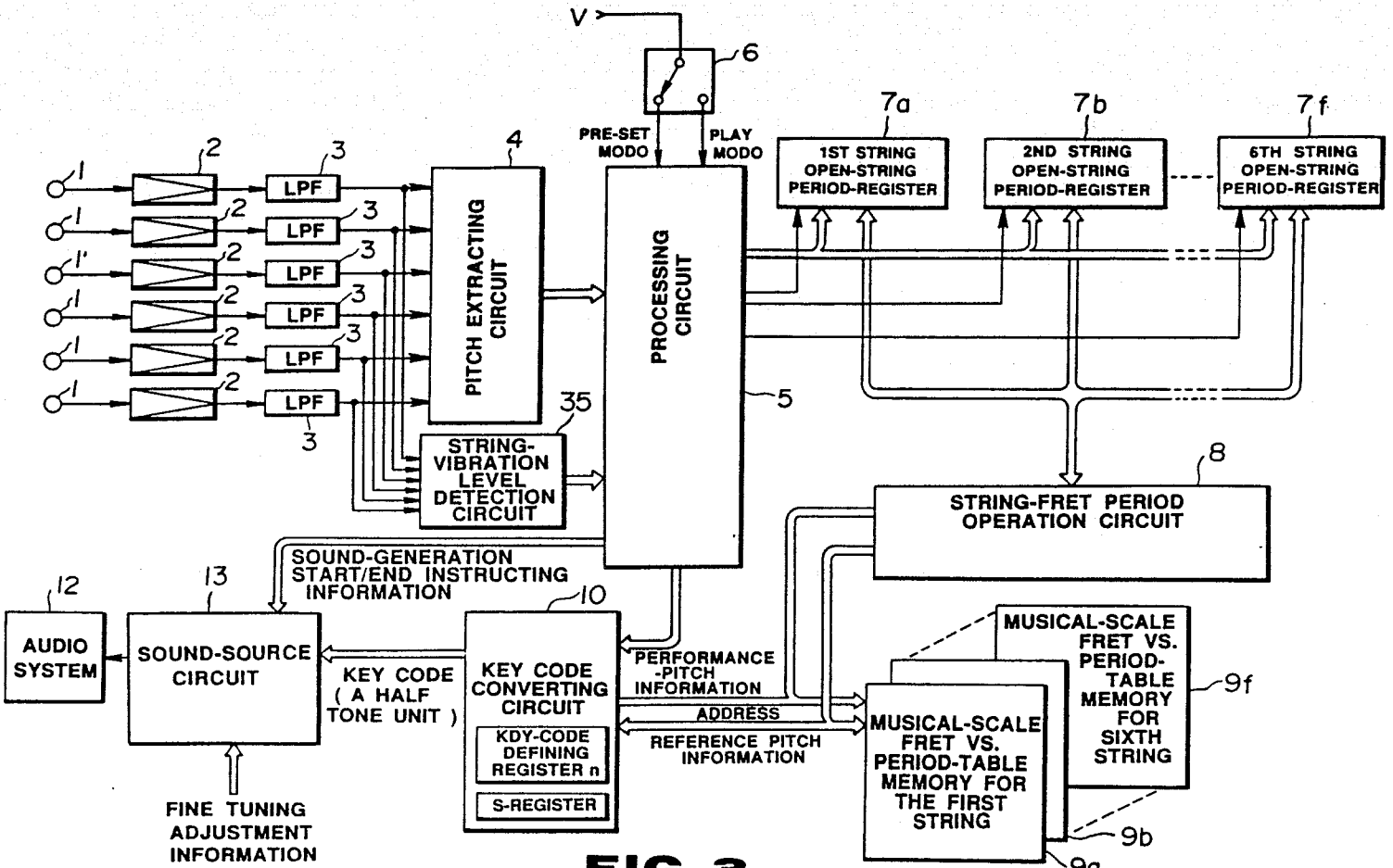
FIG. 3 is a block diagram showing a whole circuit of the first embodiment of the invention.

Electronic circuit arrangement used in the present electronic stringed instrument will be described with reference to FIG. 3.

Hexa pick-up means 1 or pick-up means 111 which are provided independently to each other for each of strings 107; the first string through the sixth string serve to detect mechanical vibrations of the strings 107 to convert into electric signals. The string-vibration signal outputted from the hexa pick-up means 1 is applied through an amplifier 2 to a low-pass filter 3, in which harmonic signals of high orders are eliminated. The cut-off frequency of the low-pass filter 3 is preferably set at different frequency for each string 107. The output of the low-pass filter 3 is applied to a pitch-extracting circuit 4 as pitch-extracting means which extracts a pitch information, i.e. the fundamental period of vibration of each string 107 to send said information to a processing circuit 5. The processing circuit 5 comprises a CPU of a micro-computer. The pitch-extracting circuit 4, in this embodiment, employs a so-called combined method of the peak-point method and the zero-cross point method, in which positive peak values and negative peak values of the string-vibration signal are detected by the pick-up means 1 and are compared to find out the peak point having a larger valve, and a point associated with said peak point is determined by a point associated with a peak point which is detected in the similar way at the same side as said peak point (i.e., at the positive side or negative side) and satisfies predetermined conditions (for example, a zero-cross point at which the waveform of the string vibration crosses the time axis right after the positive or negative peak point), and then a time interval between the starting point and the ending point is detected as the period of the string vibration. The pitch extracting circuit 4 can employ not only the above-mentioned method but also various types of methods.

The string-vibration signal from each low-pass filter 3 is also applied to a vibration-level detecting circuit 35 where the level of the string-vibration signal is detected and is sent in a digital form to the processing circuits. The processing circuit 5 discriminates starting of a sound generation of a musical tone (starting of the string plucking operation), when it detects that the string-vibration level exceeds the predetermined ON level and discriminates the termination of the sound generation of the musical tone (termination of the string-plucking operation) when it detects that the string-vibration level becomes lower than the predetermined OFF level. Information indicating the starting and/or termination of the sound generation of the musical tone is sent to a sound source as will be described later. The processing circuit 5 measures the maximum level of the string vibration as the strength of the string plucking.

The electronic stringed instrument using the present embodiment has its feature that a mode switch 6 is provided to set a pre-set mode and/or a play mode. The mode switch 6 serves to set the pre-set mode in which the state of the strings 107 of the instrument is examined before the performance and/or to set the play mode in which the sound-frequency control electronic-tuned in accordance with the result of the examination is executed during the performance. As shown in FIG. 3, the mode switch 6 is brought to a pre-set mode position to set the pre-set mode and is brought to a play mode position to set the play mode.

In the first embodiment, there are provided open-string period registers *7a* through *7f* respectively for the first string through the sixth string, a fret-period operation circuit 8, musical-scale fret vs. period-table memories *9a* through *9f* respectively for the first string through the sixth string, all of which are used during the pre-set mode. The open-string period registers *7a* through *7f* provided respectively for the first string through the sixth string store open-string period data $T_0$ to be described later, when each of the strings 107 depressed at a particular fret position, or at an open-string fret position in this embodiment, is picked (hereinafter, referred to as open-string picking) in the pre-set mode (reference-pitch information setting mode). For instance, when the pitch-extracting circuit 4 extracts a predetermined pitch from a picked open string 107, the processing circuit 5 writes the open-string period data $T_0$ of the picked string as the reference pitch-information into the corresponding open-string period register *7a* through *7f*.

The fret-period operation circuit 8 calculates string-vibration periods at other fret positions other than the open-string fret-position for each string 107 on the basis of the open-string period-data $T_0$ stored in the open-string period-registers *7a* through *7f* and writes the results of the calculation into the musical scale fret vs. period-table memories *9a* through *9f* provided for each string; the first string through sixth string.

A key-code converting circuit 10 is used in the play mode to convert the performance-pitch information which the pitch-extracting circuit 4 extracts from a particular string 107 by the plucking operation during the performance into a key-code data (fret number) for defining the sound frequency of the musical tone to be generated from a sound-source circuit 13 on the basis of the fret-pitch data stored during the pre-set mode as the reference-pitch information in the musical-scale fret vs. period-table memories *9a* through *9f*. The key-code data corresponds to each of the frets 102*b* and is composed of units of 100 cents (half tone).

The sound-source circuit 13 or musical-tone generating means generates a musical tone signal having the corresponding sound frequency, based upon the key-code data. The musical-tone signal is output as the musical tone through an audio system 12.

DESCRIPTION OF THE OPERATION

Figure 4:
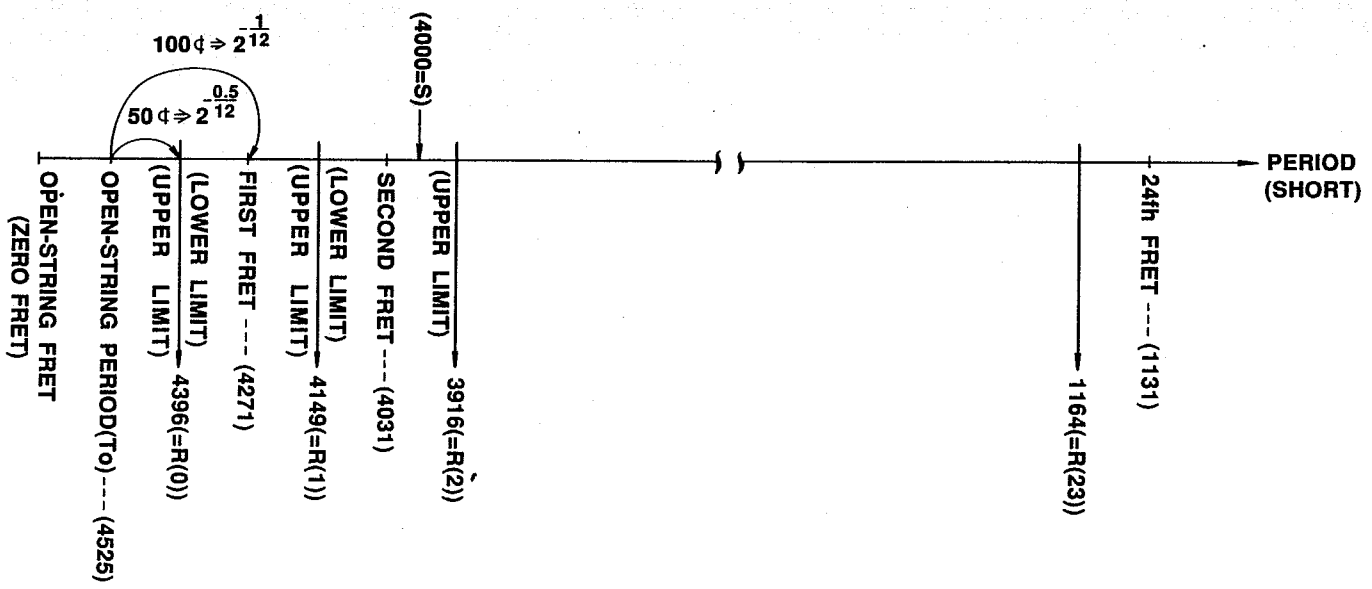
FIG. 4 shows a period table used in the first embodiment of the invention.

The operation of the first embodiment of the present invention, having the arrangement as mentioned above will be described hereinafter with reference to FIGS. 4 to 6.

Note that, in the first embodiment, the musical-interval difference between the adjacent frets 102*b* on the finger board 102*a* is a half tone, 100 cents$=2^{-1/12}$ and the fret distance FL between the frets 102*b* is uneven as in a conventional guitar.

A. Pre-set Mode

The pre-set mode will be described, in which the state of the extended strings is examined and the reference-pitch information is stored.

The mode switch 6 is brought to the pre-set position. Then a voltage V is applied to the processing circuit 5, resulting in the pre-set mode. Each string 107 which is depressed at the reference-fret position, or the open-string fret-position (O fret position) in this case is plucked (open-string picking). That is, firstly the first string is picked with the string being open, and then the pitch-extracting circuit 4 extracts the vibration period (extrocted pitch) ($T_0$) from the open-string vibration of the first string. The extracted pitch ($T_0$), or the extracted pitch data such as (4525), for example as shown in FIG. 4, is previously set as the reference-pitch information in the open-string period register *7a* for the first string or a reference-pitch information setting means. In a similar manner, all of the other strings are picked with string being open, and the extracted pitch data (open-string period data $T_0$) are extracted from these strings to be pre-set as the reference-pitch information respectively in the open-string period-registers *7b* through *7f* for the second string through the sixth string.

Then, reference-fret period information for each string with respect to each fret is calculated by the fret-period operation-circuit 8, based upon the open-string periods to for each string which have been preset in the manner described above. In the first embodiment, as shown in FIG. 4, each fret-period and its upper limit or lower limit are calculated based upon the open-string period-data $T_0$ and the results of the calculation are used as reference-fret pitch-information. An example will be explained, in which the lower limit R(0) of the fret period with respect to the first fret of the first string is calculated based upon the open-string period $T_0$ of the first string, taking, for example, a value (4525). The lower limit R(0) of the fret-period of the first fret will be given by the following equation:

$$R(0) = \text{open-string period } T_0 \times 2^{-0.5/12}$$
$$= \text{open-string period } T_0 \times 0.97153$$

Accordingly, the lower limit R(0) of the first fret of the first string can be obtained as a period (4396) which is higher than the open-string period $T_0$, (4525) of the first string by 50 cents (a half tone). The calculation of the reference-pitch information (each fret period) of each fret of the strings is executed in accordance with the flow chart for the fret-period calculation shown in FIG. 5.

Figure 5:
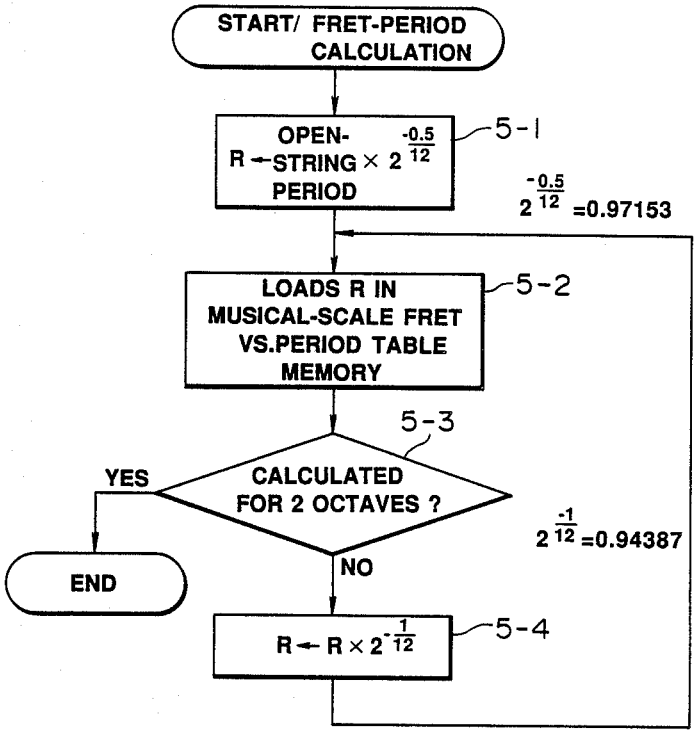
FIG. 5 is a flow chart showing a period calculation for each fret, used in the first embodiment of the invention.

FIG. 5 is a flow chart for the calculation of each fret-period showing the operation of the fret-period operation-circuit 8. In Step 5-1, the lower limit R(0) of the first fret-period is calculated for each string 107 based on the open-string period-data $T_0$ obtained from the picked open-string. The lower limit R(0) can be obtained by calculating the following equation:

open-string period data $(T_0)\times 2^{-0.5/12}$ as the difference between the open-string period data $T_0$ and the lower limit R(0) of the first fret-period is a half tene of 50 cents. The obtained lower limit R(0), (4396) is set to the first fret-register R for the first fret among the fret registers R provided corresponding to each of the frets. In the following Step 5-2, the value of the lower limit R(0), (4396) is loaded in the musical-scale fret vs. period-table memory of the corresponding string. In Step 5-3, it is decided whether or not the period calculation of the lower limits R(1), R(2) . . . R(23) for each fret is executed through the whole compass (compass of two octaves in the first embodiment). If the result is YES, that is, the period calculation of the lower limits R(1), R(2), . . . R(23) for each fret is finished, then this flow is terminated. If the result is NO, each fret period is calculated based on the open-string period-data $T_0$ in Step 5-4. In this case, as the musical-interval difference between the open-string period-data and the first fret period is 100 cents, the fret period is obtained by multiplying the open-string period-data $T_0$ loaded in the R-register by 100 cents. That is, the first-fret period-data is obtained from $R\times 2^{-1/12}$. The first-fret period which is 100 cents apart from the open-string period is calculated in this manner and is set in the corresponding R-register for the first fret and then the process returns to Step 5-2. In Step 5-2, the first-fret period-data stored in the R register is loaded in the corresponding musical-scale fret vs. period-table memory 9*a*. In Step 5-3, the calculation of each fret period thereafter is executed through the whole compass (from the second fret to the 24th fret). After completion of the calculation, the process of the flow chart shown in FIG. 5 is terminated.

Each fret period obtained by the calculation mentioned above is stored for each string 107, in the first-string musical-scale fret vs. period-table memories 9*a* through 9*f*.

B. Play Mode

An electronic tuning control during the play mode will be explained hereinafter.

During the actual performance, the pitch extracted through the string-plucking operation is input as the performance-pitch information to a key-code converting circuit 10 as a sound-frequency defining means through the processing circuit 5.

Figure 6:
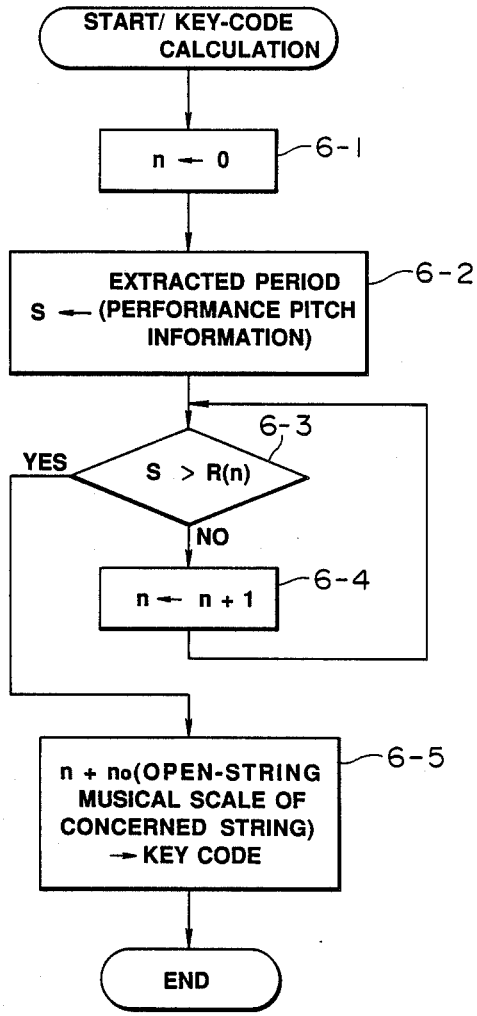
FIG. 6 is a flow chart showing a key-code calculation used in the first embodiment of the invention.
Figure 9:
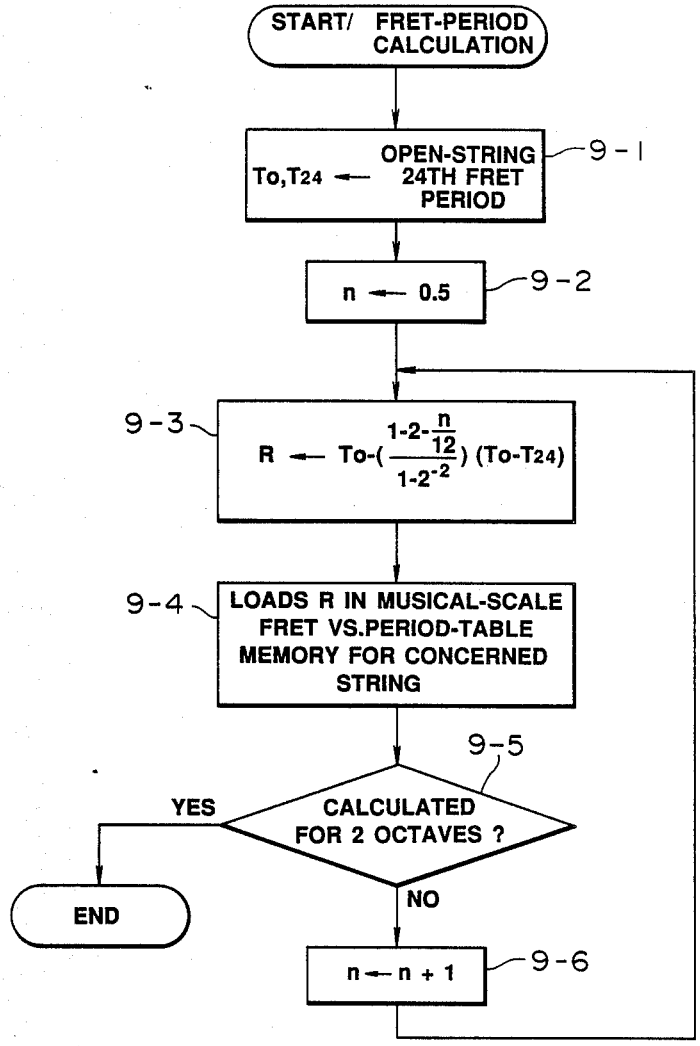
FIG. 9 is a flow chart showing a period calculation for each fret executed in the second embodiment of the invention.

FIG. 6 shows an operation flow of the embodiment in the play mode. Definitely, this operation flow shows a flow chart of a key-code calculation indicating the operation of the key-code converting circuit 10 shown in FIG. 3. In Step 6-1, a key-code (a fret number) designating register n is set to "0", thereby the register n being initialized. In Step 6-2, the period data (th performance-pitch information) extracted through the present string-plucking operation is set to a S-register. In Step 6-3, the performance-pitch information stored in the S-register and each fret-period data stored in the musical scale fret vs. period-table memory are compared, and as a result, it is examined whether or not S>R(n) is established. If the result is YES, n+no (no: open-string musical-scale of the corresponding string) is designated as a key code (a fret number) and the flow is terminated. While, if the result is NO, then the n-register is incremented by 1 and the process returns to Step 6-3, in which the operation is repeated until S>R(n) is established, resulting in YES. In the key-code converting circuit 10, the performance-pitch information and the fret-pitch information for each string as the reference-pitch information read out from the fret vs. period table memories 9*a* through 9*f* for the first string through the sixth string are compared and referred, and the performance-pitch information is converted to the corresponding key code (fret number). That is, the key-code converting circuit 10 generates the corresponding key-code data base on the performance-pitch information obtained during the live performance and the reference-pitch information previously set through the initial setting operation before the performance. The sound frequency of the musical tone to be produced by the sound-source circuit 10 is designated in accordance with the key-cod data mentioned above. For example, if the performance-pitch information defined through the plucking operation with the first string being depressed at the n-th fret position is (4000) as shown in FIG. 9, the performance-pitch information (4000) is positioned between the upper limit (R(2)=3916) of the second fret-period and the upper limit (R(1)=4149) of the first fret-period. Namely, as the following is given:

$$R(2)=3912<4000<R(1)=4149,$$

then the corresponding key-code data is obtained from the equation:

key code=n+no (no: open-string musical scale of corresponding string)

Accordingly, the key code in this case is obtained as follows: key code=2+0=2, and as the result, it is deemed that the string is picked with its second fret being depressed. The key-code data in the unit of a half tone is applied to the sound-source circuit 13, which generates the musical tone of the sound frequency corresponding to the applied key-code data, thereby the musical tone being output through the audio system 12.

Effects of the First Embodiment

Effects of the first embodiment will be described. The open-string period-data $T_0$ for each string is obtained through the previous picking operation of each string before the performance. The fret-period data R(0) through R(23) are automatically written for each string into the musical-scale fret vs. period-table data memories 9*a* through 9*f* in accordance with these open-string period-data $T_0$. When the plucking operation is executed with the string being depressed at an arbitrary fret position during the actual performance, the musical tone is generated with the sound frequency corresponding to the plucked string being appropriately electronic-tuned based on the fret-period data R(0) through R(23), so that an electronic stringed instrument of an electronic tuning type is available, which requires no special tuning operation at all.

Second Embodiment

Figure 7:
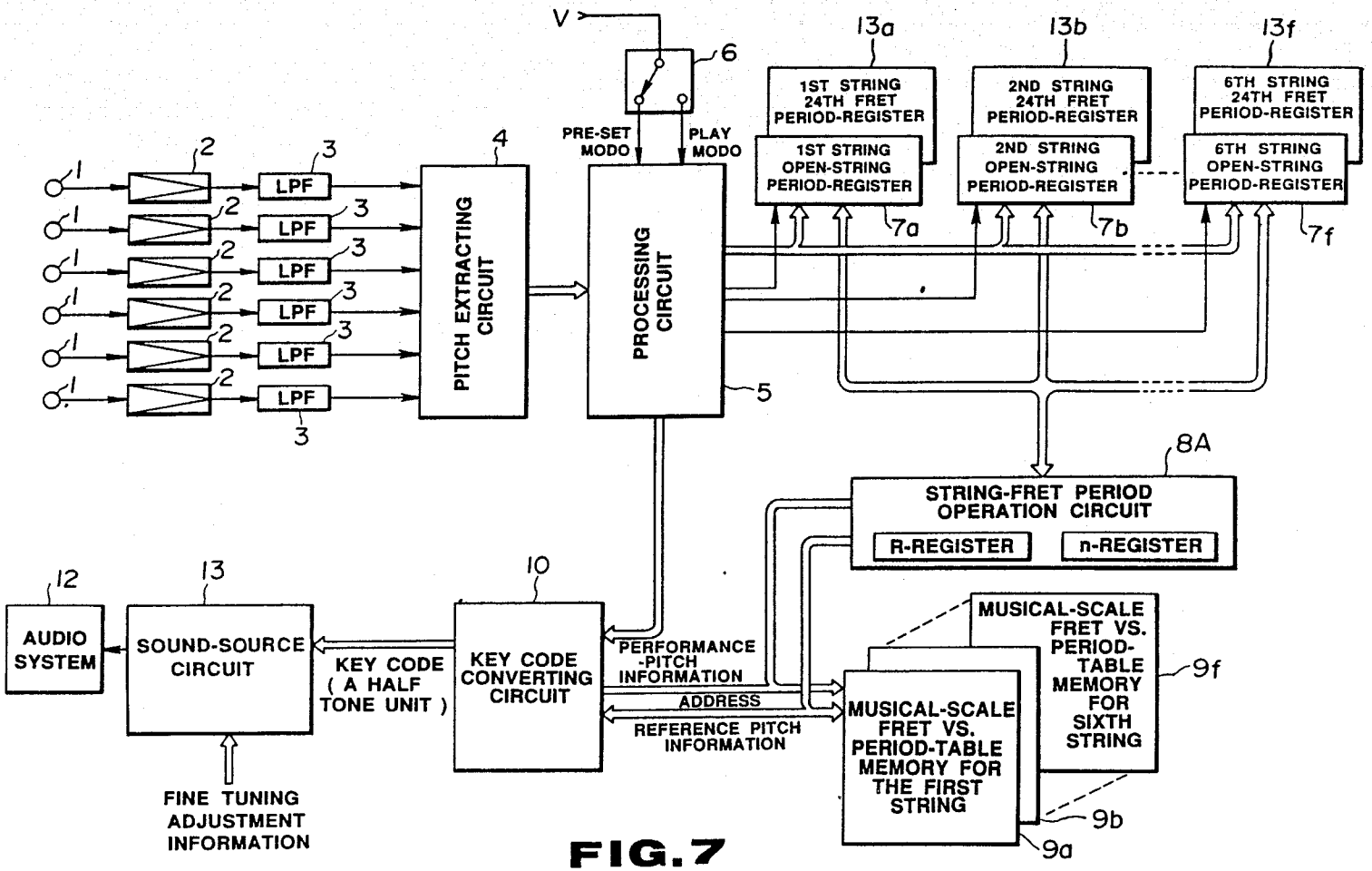
FIG. 7 is a block diagram showing a whole circuit of the second embodiment of the present invention.

The second embodiment of the present invention will be described. FIG. 7 is a block diagram showing a whole circuit arrangement of the second embodiment, in which like reference symbols of the first embodiment shown in FIG. 3 have like functions and a further description thereof will be omitted.

The second embodiment shows the present invention which is applied to an electronic stringed instrument having uneven fret-intervals FL from the first fret to the 24th fret and a string-length interval GL of an inappropriate length.

The second embodiment differs from the first embodiment in the following arrangements. Firstly, the 24th fret-period registers 13*a* through 13*f* in addition to the open-string period-registers 7a through 7f are provided for each string to store as the reference-pitch information the 24th fret-period data $T_{24}$ as well as the open-string fret-period data $T_0$ (in this embodiment, the electronic stringed instrument has the compass of two octaves from the first fret to the 24th fret, so that the 24th fret-position of the highest sound frequency is designated as one of the reference-fret position). Secondly, the fret-period and its upper or lower limit for other frets other than the open-string fret and the 24th fret are obtained in the fret-period operation circuit 8A based on both the open-string period-data $T_0$ and the 24th fret-period data $T_{24}$, pre-set in the registers, 7a through 7f and 13a through 13f. And the open-string period-data $T_0$, the 24th fret-period data $T_{24}$, and other fret-period data Tn are stored in the musical-scale fret vs. period-table memories 9a–9f, respectively. Other arrangements of the second embodiment are similar to those of the first embodiment.

One of features of the second embodiment, the fret-period operation circuit 8A, or the operation of said circuit 8A will be mainly described hereinafter with reference to FIGS. 8 and 9. That is, the fret-period operation-circuit 8A operates to obtain the upper and lower limit of the fret-period $T_l$ through Tn for the strings other than the open string-fret and the 24th fret on the basis of the open-string period-data $T_0$ and the 24th fret-period data $T_{24}$ which are obtained through picking of the 24th fret-string as well as the open string and then respectively stored in the open-string period-registers 7a through 7f and the 24th fret period-registers 13a through 13f.

Figure 8:
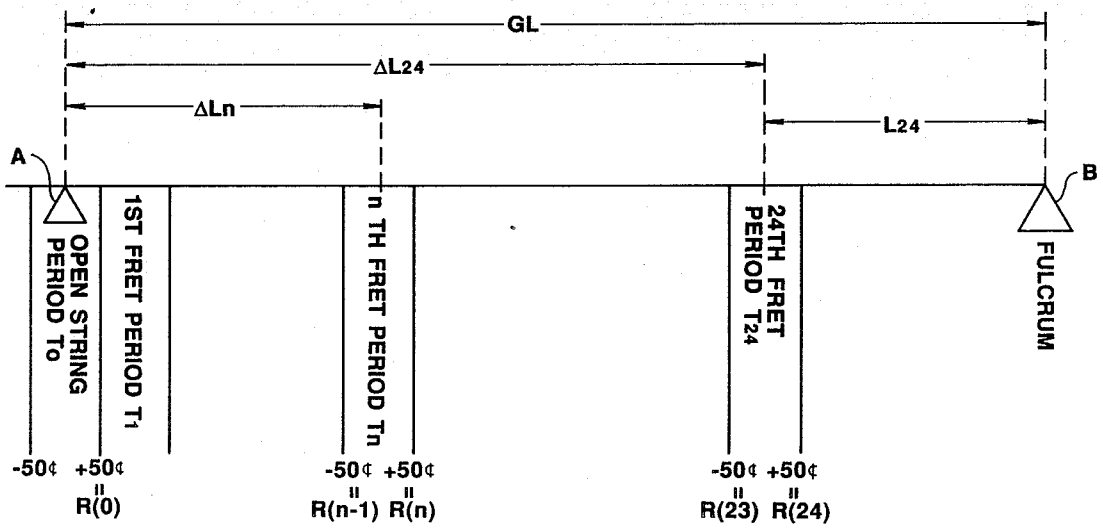
FIG. 8 is a period table used in the second embodiment of the present invention.

With reference to FIG. 8, the relationship between the string-length interval GL and the fret intervals Δln, $\Delta l_{24}$, ;$_{24}$ is described. In FIG. 8, GL represents the string-length interval between the supporting point A indicating the string-supporting point on the string-supporting portion 126 of the head 124 and the supporting point B indicating the string-supporting point on the string-supporting portion 205 of the body 101, $l_{24}$ represents an interval from the supporting point B to the 24th fret position, $\Delta l_{24}$ represents an interval from the open-string fret-position, i.e., the zero fret position to the 24th fret position Δln represents an interval from the zero fret position to the n-th fret position, $T_0$ represents the open-string period-date, and $T_{24}$ represents the 24th fret-period data. Then, the fret-period data Tn for the n-th fret position can be obtained as follows:

$$l_{24}:(l_{24} + \Delta l_{24}) = T_{24}:T_0 \text{ so that,}$$

$$l_{24} = \frac{T_{24}}{T_0 - T_{24}} \cdot \Delta l_{24} \quad (1)$$

$$T_0:Tn = (\Delta l_{24} + l_{24}):(\Delta l_{24} - \Delta ln + l_{24}) \text{ so that,}$$

$$Tn = \frac{\Delta l_{24} - \Delta ln + l_{24}}{\Delta l_{24} + l_{24}} \cdot T_0$$

Substituting Eq.(1) in the above equation, we obtain $$Tn = \frac{\Delta l_{24} T_0 - \Delta ln(T_0 - T_{24})}{\Delta l_{24}} \quad (2)$$

where Δln: $\Delta l_{24} = (1\text{-}2^{-n/12})$: $(1\text{-}2^{-24/12})$. Deforming the Eq.(2), we obtain $$Tn = T_0 - \frac{1 - 2^{-n/12}}{1 - 2^{-2}} \cdot (T_0 - T_{24})$$

By substituting n=0.5, 1.5 . . . in the above equation, the fret-period data Tn corresponding to n-values can be obtained, that is, the lower limits for each fret, or the lower limits which are lower than each fret-period data $T_0$ by 50 cents can be obtained through the fret-period calculation. This fret-period calculation is performed in accordance with the flow-chart shown in FIG. 9.

FIG. 9 is the flow-chart showing the fret-period calculation executed in the second embodiment. In Step 9-1, the open-string period-data $T_0$ and the 24th-fret period-data $T_{24}$ are obtained respectively through the open-string picking and the string picking with the string being depressed at the 24th fret-position (hereinafter, referred to as "the 24th fret picking"). These period data $T_0$, $T_{24}$ are pre-set in the corresponding open-string period-registers 7a through 7f and the corresponding 24th fret-period registers 13a through 13f, respectively. In Step 9-2, the value of 0.5 is set in the n-register. In Step 9-3, by substituting 0.5 set in the n-register in the following formula:

$$T_0 - \left(\frac{1 - 2^{-n/12}}{1 - 2^{-2}}\right)(T_0 - T_{24}),$$

the lower limit of the fret-period data Tn for the n-th fret position is calculated in the fret-period operation-circuit 8A and the calculation result or the lower limit R(0) of the first fret-period is set in the R-register. In Step 9-4, the value R(0) in the R-register is loaded to the musical-scale fret vs. period-table memory 9a through 9f of the pertinent string. Further in Step 9-5, it is judged whether or not the period calculation is completed for two octaves from the lower limit R(1) of the second fret-period data to the lower limit R(24) of the 24th fret-period data, and if the result is YES, then the flow is terminated. If the result is NO, the process advances to Step 9-6. In Step 9-6, the n-register is incremented by 1 and the process returns to Step 9-3 where the period calculation of the lower limit of the fret-period data $T_2$ for the second fret position and the load of the calculated lower limit to the corresponding musical-scale fret vs. period-table memory are performed. Hereafter, a series of Steps 9-6, 9-3, 9-4, 9-5 are repeated until the lower limit R(23) of the 24th fret-period data $T_{24}$ is obtained. The key-code calculating method in the second embodiment is the same as that in the first embodiment and a further description thereof will be omitted.

Effects of the second embodiment will be described. Even in the electronic stringed instrument applied in the second embodiment in which the intervals (the string-length intervals GL) between the supporting points on each string-supporting portion for extending the string are inappropriate relative to each fret-position, the fret-period data $T_l$ through Tn are calculated by the fret-period operation-circuit 8A base upon the open-string period-data $T_0$ and the 24th fret-period data $T_{24}$ which are obtained before the performance through the open-string picking and the 24th fret picking, respectively. Then, the fret-period data $T_0$ through $T_{24}$ are stored in the musical-scale fret vs. period-table memories 9a through 9f. Accordingly, even in the case the string-length intervals GL are inappropriate relative to each fret position, the fret-period data $T_0$ through $T_{24}$ compensating those inappropriate string-length are stored in the period-table memories 9a through 9f, so that during the performance, the sound frequency of the plucked string is generated in a properly tuned state based on the fret-period data $T_0$ through $T_{24}$. As in the first embodiment, the electronic stringed instrument of an electronic tuning type is available, which requires no particular tuning operation.

Third Embodiment

The third embodiment of the present invention will be described referring to FIGS. 10 and 11.

Figure 10:
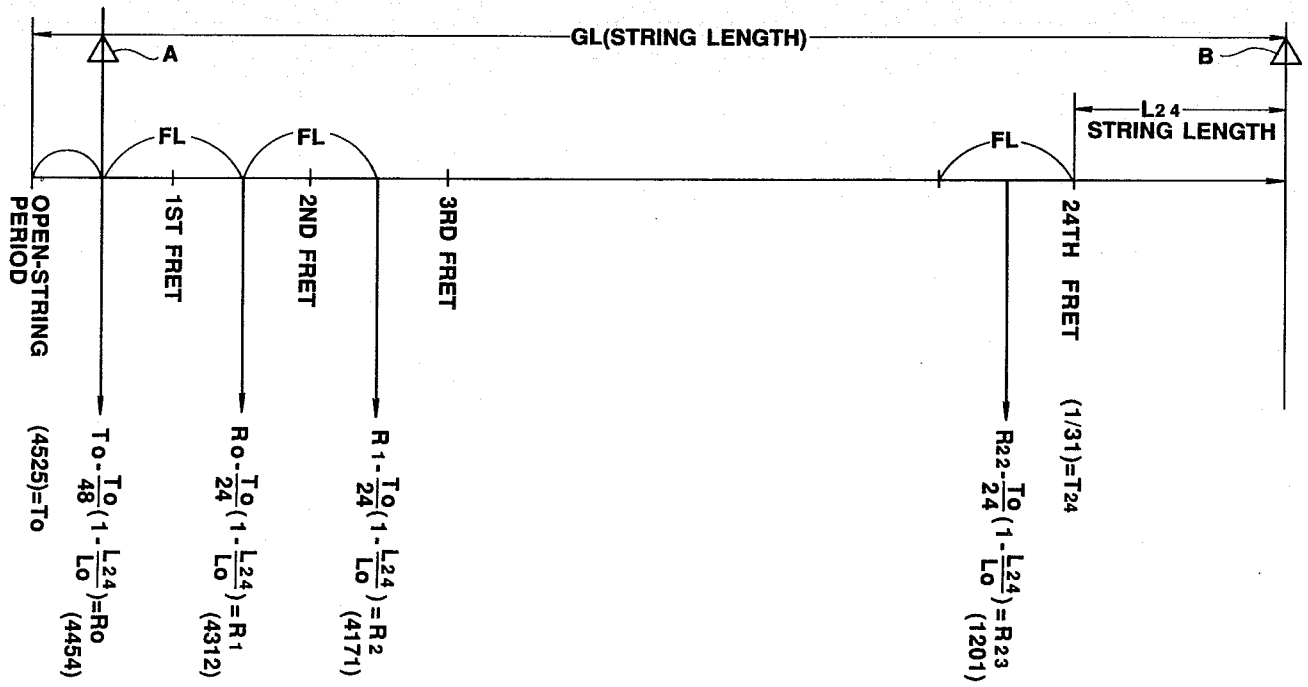
FIG. 10 is a period table use in the third embodiment of the present invention.

The third embodiment indicates an application of the present invention to an electronic stringed instrument in which the first fret through the 24th fret are aligned at even interval FL as schematically shown in FIG. 10, differing from the conventional stringed instrument with the frets being unevely arranged. In the third embodiment, the calculation method of period data to be performed by the fret-period operation-circuit 8 differs from that in the first embodiment, which allows the instrument to generate musical tones in a properly tuned state during the performance, even in the application of the present invention to the stringed instrument mentioned above. Accordingly, with respect to the third embodiment, the calculation method of period data will be mainly described and the other matters are similar to those in the first embodiment shown in FIG. 3 and a further description thereof will be omitted. The open-string period-data $T_0$ obtained through the plucking operation of each open string are initially set in the corresponding open-string period-registers 7a through 7f.

Figure 11:
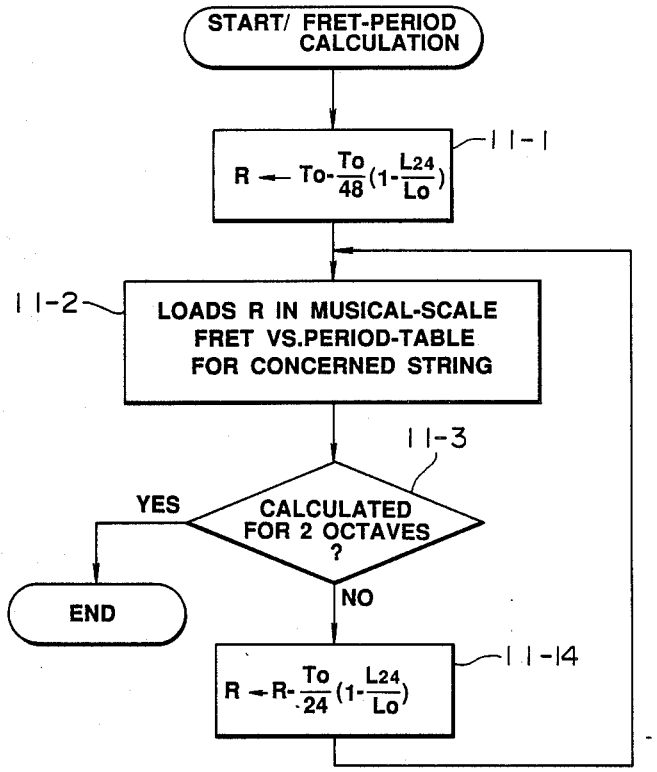
FIG. 11 is a flow chart showing a period calculation for each fret, used in the third embodiment of the invention.

The fret periods for each string with respect to each fret are calculated based on the open-string period-data $T_0$ in accordance with the flow shown in FIG. 11. In step 11-1 of FIG. 11, by substituting the open-string period-data $T_0$ in the following formula:

$$T_0 - \frac{T_0}{48}\left(1 - \frac{l_{24}}{l_0}\right),$$

the values thereof are obtained as the lower limit periods $R_0$ of the first fret and the obtained values are set in the R-register. GL represents an effective vibration-length (string-length interval) with which the picked string vibrates and $l_{24}$ represents an effective vibration-length with which the string is vibrated by the 24th fret picking. That is, in the present embodiment, GL is given by the actual length (a distance between a pair of supporting points A, B on the string supporting portions) of the string extended on the instrument and $l_{24}$ is also given by the length of the string between the supporting point B at the body side and the 24th fret position.

In Step 11-2, the lower limit period $R_0$ for the first fret is loaded in the corresponding musical-scale fret vs. period-table memory 9a through 9f. In Step 11-3, it is judged whether or not the calculation of the lower limit periods $R_1$ through $R_{23}$ is executed for two octaves from the lower limit period of the first fret to the lower limit period of the 24th fret. If the result is YES, then the flow is terminated. If the result is NO, the process advances to Step 11-4. In Step 11-4, the formula, $$R_{n-1} - \frac{T_0}{24}\left(1 - \frac{l_{24}}{l_0}\right)$$

is calculated by substituting the lower limit period Rn of the n-th fret and the calculated value is set in the R-register. Then, the process returns to Step 11-2 and a series of Steps, Step 11-3, Step 11-4, Step 11-2 are repeated to calculate all of the lower limit periods $R_0$ through $R_{23}$ for two octaves. In FIG. 10, if $l_{24}/GL=0.25$, then periods $R_0$ through $R_{23}$ are given by numbers shown in parentheses.

In this manner, the calculation of particular period data $R_0$ through $R_{23}$ is completed in the third embodiment. Thereafter, the following process is the same as that in the first embodiment. The obtained lower limit period data $R_0$ through $R_{23}$ with respect to frets for each string are stored as the reference-pitch information in the musical-scale fret vs. period-table memories 9a through 9f for the first string through the sixth string. During the performance, the performance-pitch information obtained by the pitch extracting circuit 4 and the processing circuit 5 through the string plucking operation is converted into the corresponding key code in the key-code converting-circuit 10 on the basis of the calculated reference-pitch information, and the required sound frequency of the musical tone is designated in accordance with the key code.

Figure 15:
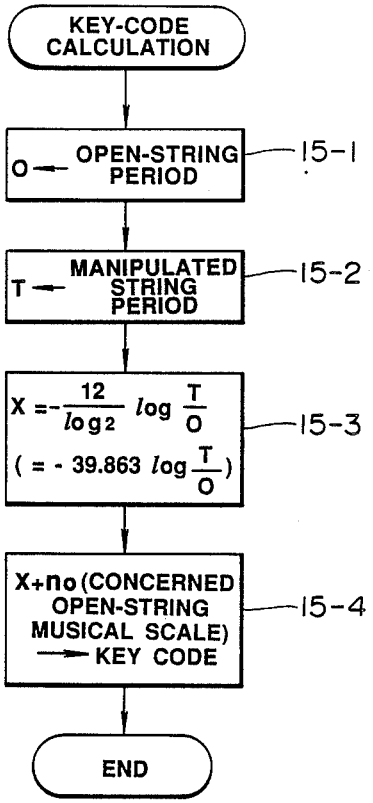
FIG. 15 is a flow chart showing a key-code calculation used in the fifth embodiment of the invention.

Even in the electronic stringed instrument with the frets being aligned at even intervals FL on the finger board, the fret-period operation-circuit 8A in the third embodiment calculates fret-periods appropriate for evenly aligned frets 102 in accordance with the calculation method of the fret-period shown in FIG. 15. Accordingly, as in the first embodiment, the pre-setting of the open-string period-data for each string through the open-string picking prior to the performance permits the performance of musical tones having a sound frequency properly toned without any particular tuning operation.

Even in the electronic stringed instrument having frets aligned at even interval FL as described in the third embodiment, musical tones of a properly tuned sound frequency can be obtained. As a result, this arrangement permits the frets to be aligned through the whole composs at an even interval which corresponds to the narrow fret interval at high compass region. In a conventional guitar, the frets are aligned so as to gradually increase the distance FL therebetween along the fingerboard from the high compass region to the low compass region, so that only several frets covering two octaves (the first fret through the 24th fret) can be aligned within the fingering area, while according to the arrangement as in the third embodiment, an electronic stringed instrument is available, which has a number of frets aligned for covering a compass of approximately four octaves wider than two octaves.

Fourth Embodiment

Figure 12:
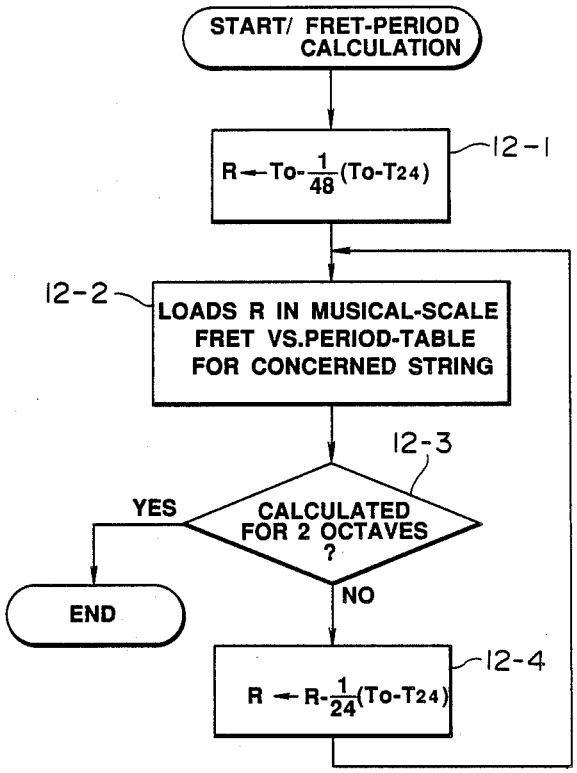
FIG. 12 is a flow chart showing a period calculation for each fret, used in the fourth embodiment of the present invention.

The fourth embodiment of the present invention will be described referring to FIG. 12. The whole arrangement of the fourth embodiment is similar to that of the second embodiment shown in FIG. 7 and a further description of the similar portion will be omitted. In the fourth embodiment, the fret intervals FL are even as in the third embodiment and the invention is applied to an electronic stringed instrument, the string-length interval GL of which is not inappropriate. The fourth embodiment differs from the third embodiment in that in consideration of the string-length interval not being inappropriate, the 24th string period-date $T_{24}$ in addition to the open-string period-data $T_0$ are calculated in accordance with the flow of the fret-period calculation shown in FIG. 12 as in the second embodiment.

The process of the fret-period calculation which is one of the features of the fourth embodiment will be described referring to the flow shown in FIG. 12. In Step 12-1 of FIG. 12, the open-string period-data $T_0$ and the 24th fret-period data $T_{24}$ obtained in the similar manner to the third embodiment are stored in the open-string period-registers 7*a* through 7*f* and the 24th fret period-registers 13*a* through 13*f*, respectively, then, the value of the formula $T_0 - 1/48\ (T_0 - T_{24})$ is obtained by substituting the period data $T_0$, $T_{24}$, as the lower limit period $R_0$ for the first fret by means of the fret-period operation-circuit 8A. Thus obtained value is set to the R-register. Step 12-2, the value $R_0$ as stored in the R-register is loaded into the musical-scale fret vs. period-table memory. In Step 12-3, as in the third embodiment, it is judged whether or not the values in the R-register are calculated through two octaves. If the result is YES, the flow is terminated. If the result is NO, $R\text{-}1/24(T_0 - T_{24})$ is set as the value in the R-register and the process returns to Step 12-2 and then the flow is repeated. The method for obtaining the key code is similar to that in the third and first embodiment.

The operation of the fourth embodiment will be described. The open-string period-data $T_0$ and the 24th fret period-data $T_{24}$ are pre-set in the first string through the sixth string open-period registers 7*a* through 7*f* and the first string through the sixth string open period registers 13*a* through 13*f* by the open-string picking for each string and the 24th fret picking for each string prior to the performance. In addition, the period data of each fret for each string are obtained based on the two types of period data by the period-operation circuit 8A. Thus obtained period data are stored as the reference-pitch information in the first through sixth string musical-scale fret vs. period-table memories 9*a* through 9*f*. During the performance, the performance-pitch information obtained through the actual string-plucking operation is converted, as in the second embodiment, into the properly tuned key code by the key-code converting circuit 10. Thereafter, the musical tones are generated in a similar manner to the second embodiment.

The effects of the fourth embodiment are as follows. Even in the electronic stringed instrument, differing from the conventional guitar, frets of which are aligned at an even interval and the string length of which is not inappropriate, the arrangement of the fourth embodiment permits performance with musical tones having a sound frequency which is properly tuned only through the open-string picking and the 24th fret picking prior to performance, as in the third embodiment. In addition, the arrangement of the fourth embodiment provides an electronic string instrument which has frets covering a wide compass of about four octaves.

Fifth Embodiment

Figure 13:
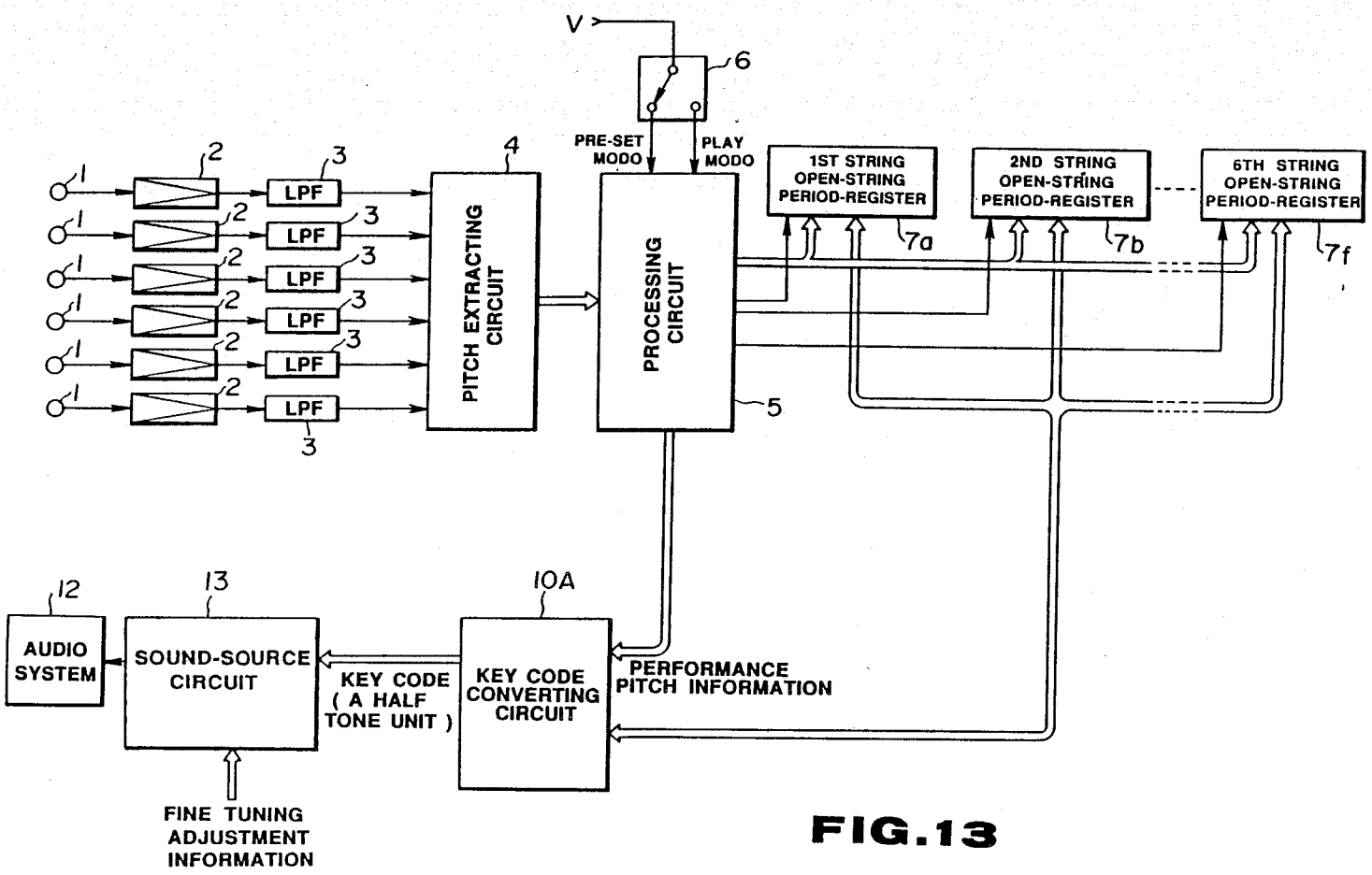
FIG. 13 is a block diagram of a whole circuit of the fifth embodiment of the present invention.

The fifth embodiment of the present invention will be described referring to FIG. 13 showing the whole arrangement of the fifth embodiment. In the present embodiment, like reference symbols represent like elements of the first embodiment shown in FIG. 1 and a further description thereof will be omitted.

The fifth embodiment illustrates an application of the invention which is employed in the electronic stringed instrument having frets being aligned at uneven intervals and strings being extended with proper intervals, as in the first embodiment.

The arrangement of the fifth embodiment differs from that of the first embodiment in that the fifth embodiment has no string-fret period-operation circuit and no musical-scale fret vs. period-table memory. The fifth embodiment is arranged so as to obtain predetermined key codes at a real time based on the open-string period-data $T_0$ by the process of the key-code converting-circuit 10A controlled by the processing circuit (CPU). The above mentioned data $T_0$ is obtained through the open-string picking for each string.

The operation of the fifth embodiment will be described referring to the flow chart of FIG. 15 which shows the process of the key-code calculation by the key-code converting circuit 10A.

In Step 15-1, the open-string period-data $T_0$ for each string are set in ZERO-register in the open-string period-register 7*a* through 7*f* of the first through sixth string. This operation is the same as that of the first embodiment. In Step 15-2, a manipulated-string period T extracted through picking of a certain string depressed at a predetermined fret position is set in a T-register. In Step 15-3, by substituting the manipulated-string period T stored in the T-register in the following equation:

$$X = -\frac{12}{\log 2} \times \log \frac{T}{0} \left( = -39.863 \log \frac{T}{0} \right)$$

the fret number X is obtained. In Step 15-4, the fret number $X + n_0$ ($n_0$ is the open-string musical-scale of the concerned string) is calculated as the key-code, and then the flow is terminated.

Figure 14:
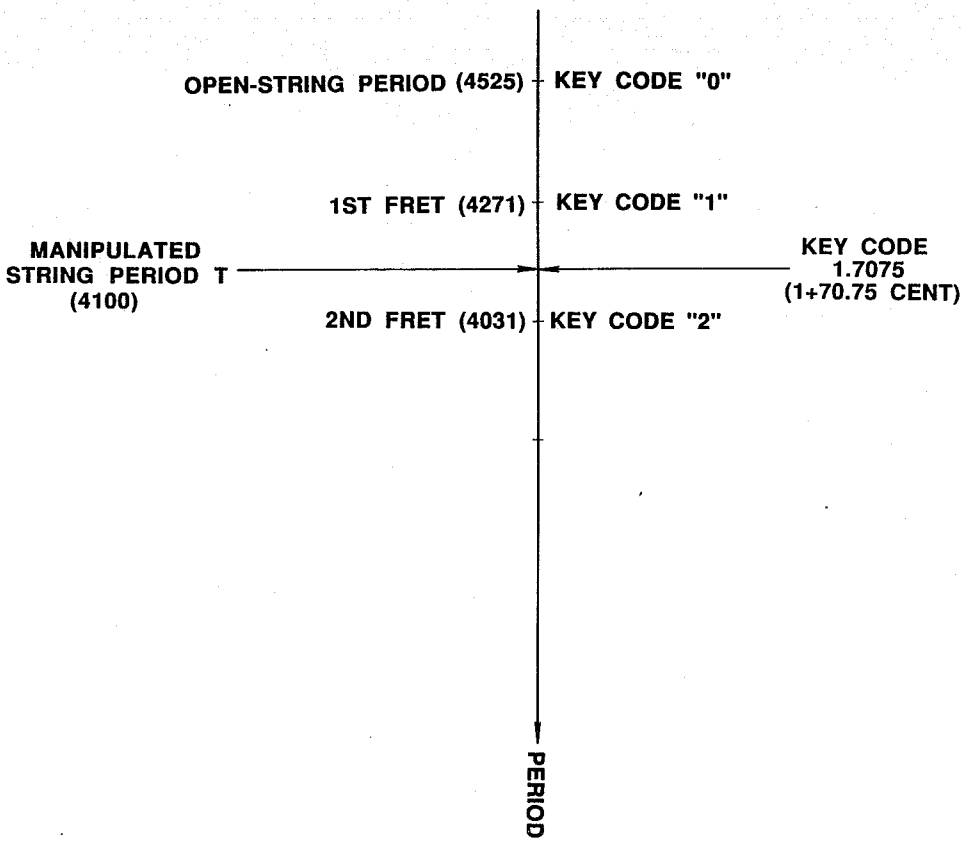
FIG. 14 is a period chart used in the fifth embodiment of the invention.

An example in which data 4100 is extracted as the manipulated-string period T during the actual performance will be described referring to FIG. 14. The key code can be obtained from the following equation:

$$X = -\frac{12}{\log 2} \cdot \log \frac{T}{0} = -\frac{12}{\log 2} \cdot \log \frac{4100}{4525} = 1.7075$$

In this case, if the key code of the open-string musical-scale $n_0$ of the concerned string is "0", the key code obtained through the actual performance will be given by the following equation: $X + n_0 = X + 0 = 1.7075$. Accordingly, the key-code generating-circuit 10A designates the sound frequency corresponding to the key code which is given by the quantity 1.7075 added to the key code "0" of the open-string musical-scale.

The operation of the fifth embodiment will be described. Prior to the performance, the open-string period-data $T_0$ obtained through the open-string picking as similar to the first embodiment is pre-set in the open-string period-registers 7*a* through 7*f* for the first through sixth string. During the performance, as in the first embodiment, the performance-pitch information is obtained through the string-plucking operation by means of the pitch-extracting circuit 4 and the processing circuit (CPU)5 and said performance-pitch information is converted into the key code based on the open-string period-data $T_0$ in the key-code converting circuit 10A. The operation thereafter is the same as that of the first embodiment.

The effects of the fifth embodiment will be described. In the arrangement of the fifth embodiment, the open-string period-data is extracted prior to the performance and is set in the open-string period-register *7a* through *7f* for the first through sixth string. During the performance, the performance-pitch information actually extracted is converted at real time into the key code in accordance with the pre-set open-string period in the key-code converting-circuit 10A, so that the arrangement of the fifth embodiment requires no circuit for calculating string-fret period and no musical-scale fret vs. period-table memory. Hence, the key codes can be obtained at real time with a simple arrangement. Further, the arrangement uses no musical-scale fret vs. period-table memory for each half tone, so that it can generate musical tones having a predetermined sound frequency under the fine pitch tuning condition of less than a half tone.

Sixth Embodiment

Figure 16:
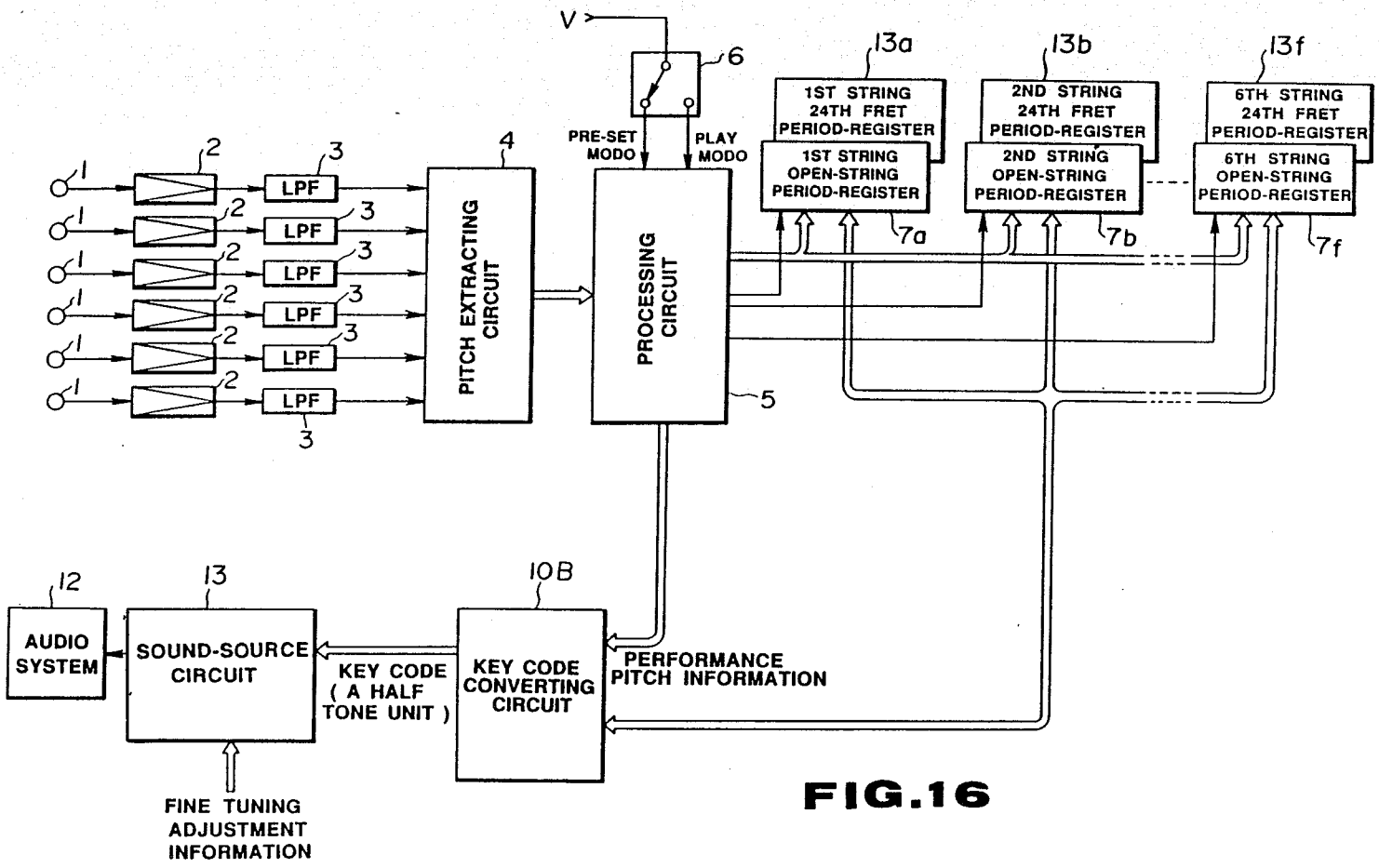
FIG. 16 is a block diagram of a whole circuit of the sixth embodiment of the present invention.

The sixth embodiment will be described referring to FIG. 16. The sixth embodiment illustrates the present invention which is applied to the electronic stringed instrument, frets of which are aligned at uneven intervals but the string-length interval of which is inappropriate as in the conventional guitar. FIG. 16 shows the whole circuit arrangement of the sixth embodiment. A further description of like elements of the fifth embodiment shown in FIG. 13 will be omitted The arrangement of the sixth embodiment differs from that of the fifth embodiment in that the present arrangement is provided with the 24th fret-period registers 13*a* through 13*f* of the first through sixth string for pre-setting the 24th fret period for each string, in addition to the open-string period registers *7a* through *7f* of the first string through the sixth string for pre-setting the open-string period-data for each string prior to the performance. Other than the above mentioned is the same as the fifth embodiment, and the string-fret period-operation circuit 8A for calculating string-fret periods during the performance and the musical-scale fret vs. period-table memories 9*a* through 9*f* are not provided in the arrangement.

Figure 17:
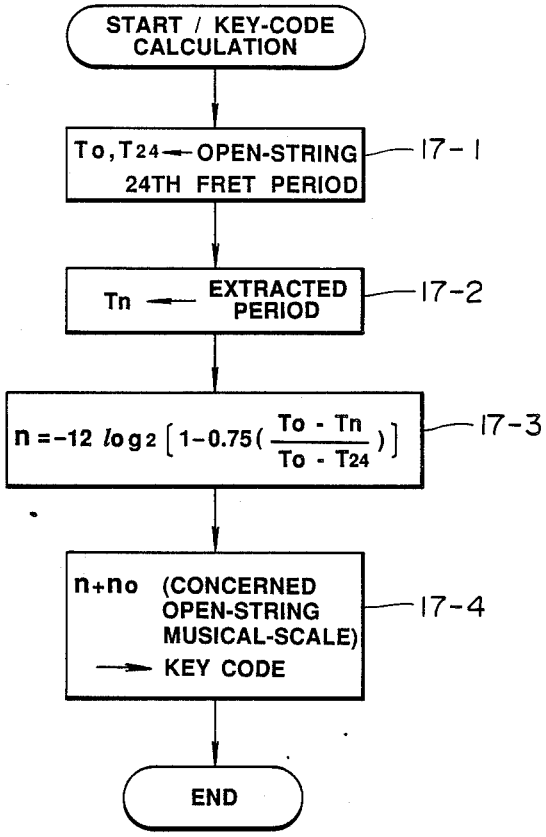
FIG. 17 is a flow chart showing a key-code calculation used in the sixth embodiment of the invention.

The process for obtaining a predetermined key code will be described referring to the flow chart of the key-code calculation shown in FIG. 17. The process starts with the step of loading the open-string period data $T_0$ and the 24th fret period-data $T_{24}$ into the concerned registers *7a* through *7f* and 13*a* through 13*f* respectively and terminates in the step of converting the actually obtained performance-pitch information based on the period data $T_0$ and $T_{24}$ by the key-code converting-circuit 10A in order to obtain a predetermined key code. In Step 17-1, the open-string period-data $T_0$for each string and the 24th fret-period $T_{24}$ for each string are extracted through the open-string picking and the 24th fret picking, and these period data $T_0$, $T_{24}$ are pre-set in the concerned open-string period-registers *7a* through *7f* and the 24th fret period-registers 13*a* through 13*f*. In Step 17-2, the period data extracted through the actual picking during the performance is loaded into the Tn-register. In this case, the period data mentioned above is calculated from the following formula:

$$T_0 - \left(\frac{1 - 2^{-n/12}}{1 - 2^{-2}}\right)(T_0 - T_{24})$$

In Step 17-3, the fret number n is directly calculated using said period from the equation:

$$n = -12 \log 2 \left[1 - 0.75 \left(\frac{T_0 - T_n}{T_0 - T_{24}}\right)\right]$$

In Step 17-4, the quantity $n+n_0$ (the open-string musical-scale of the concerned string) is obtained as the key code and then the flow terminates.

The operation of the sixth embodiment will be described. Prior to the performance, as in the second embodiment, the open-string period-data $T_0$ for each string is extracted through the open-string picking, and the extracted period data $T_0$ is pre-set in the open-string period-registers *7a* through *7f* respectively. Furthermore, the 24th fret period-data $T_{24}$ for each string is extracted through the 24th fret picking of each string and the period data $T_{24}$ are pre-set in the concerned 24th fret period-registers 13*a* through 13*f*. During performance, the string-vibration pitch is obtained as the performance-pitch information as in the second embodiment and this performance-pitch information is converted into the corresponding key code by the key-code converting-circuit 10B based on said open-string period-data $T_0$ and said 24th fret period-data $T_{24}$, both of which are previously pre-set in the registers prior to the performance. The operation thereafter is the same as that of the second embodiment. Namely, musical tones having the corresponding sound frequency are generated by the sound-source circuit 13 in accordance with the key codes and said musical tones are output through the audio system 12.

The effect of the sixth embodiment is that the arrangement of the sixth embodiment requires no string-fret period-operation circuit and no musical-scale fret vs. period-table memories for the six strings. Because in the arrangement of the sixth embodiment, prior to the performance the open-string period-data $T_0$ extracted through the open-string picking and the 24th fret period-data $T_{24}$ extracted through the 24th fret picking are pre-set in the concerned open-string period-registers *7a* through *7f* and the concerned 24th fret period-registers 13*a* through 13*f*, and during the performance, the performance-pitch information actually extracted is converted into the key code at real time by the key-code converting-circuit 10B based on said open-string period-data $T_0$ and said 24th fret period-data $T_{24}$. Accordingly, the sixth embodiment permits the calculation of the key code at real time with a simple arrangement and it also permits the generation of musical tones having the sound frequency in the proper tuning state even in the electronic stringed instrument having an inappropriate string-length interval GL, because in the present embodiment, the 24th fret-period data $T_{24}$ in addition to the open string period-data $T_0$are pre-set in the corresponding registers in the initial setting operation and the predetermined key codes are obtained based on both said period data $T_{24}$ and $T_0$.

Seventh Embodiment

Figure 18:
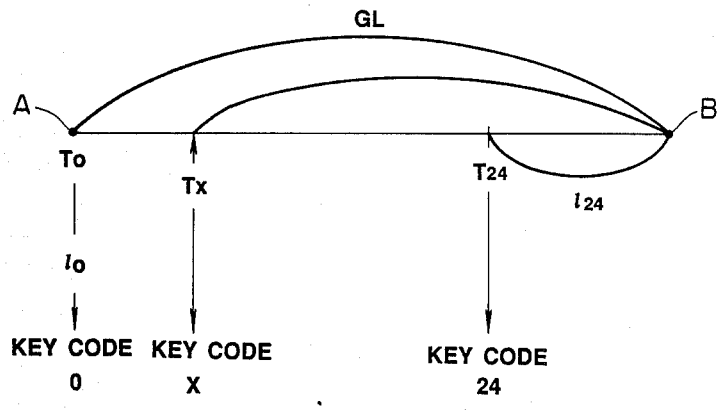
FIG. 18 is a period chart used in the seventh embodiment of the present invention.

The seventh embodiment of the present invention will be described referring to FIGS. 18 and 19. Th seventh embodiment illustrates the present invention which is applied to the electronic stringed instrument having an even fret period FL and a correct string-length interval. The whole arrangement of the electronic circuit is the same as that of the fifth embodiment shown in FIG. 13. In the seventh embodiment, however, the calculation process of the key code by the key-code converting-circuit 10A is different from that of the fifth embodiment so as to enable the seventh embodiment to be applied to the electronic stringed instrument having the frets aligned at an even fret interval. The key-code calculation-process from extracting the open-string period-data $T_0$ through the open-string picking to obtaining a predetermined key code through the actual picking during performance will be described referring to the key-code calculation-flow shown in FIG. 19.

Figure 19:
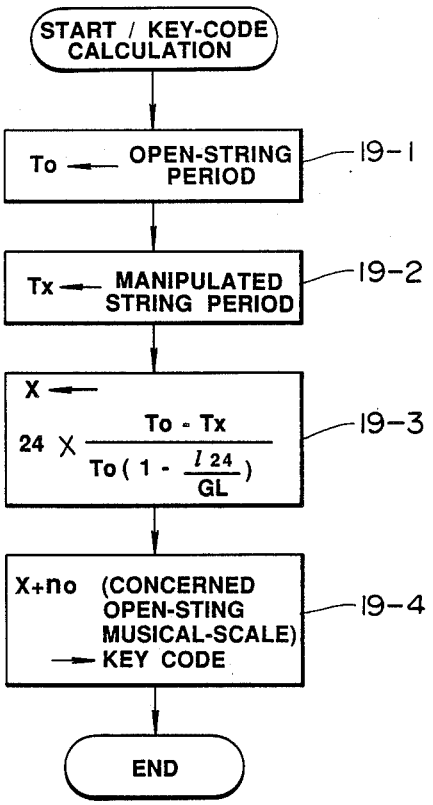
FIG. 19 is a flow chart showing a key-code calculation used in the seventh embodiment of the present invention.

In Step 19-1 of FIG. 19, the open-string period-data $T_0$ for each string are extracted through the open-string picking and are pre-set in the corresponding open-string period-registers *7a* through *7f*. In Step 19-2, the manipulated-string period-data is extracted through the actual picking during performance and is temporarily stored in th Tx-register in the key-code generating circuit 10A. In Step 19-3, the key-code X corresponding to said manipulated string period-data Tx is obtained based on the open-string period-data $T_0$ and the manipulated-string period-data Tx stored in the corresponding register respectively. In this case, $$(Tx - T_0): X = (T_0 - T_{24}): 24$$

$$T_{24} = T_0\left(1 - \frac{GL}{l_{24}}\right)$$

then, the key code X can be obtained from the above equation, where the string-length interval GL is given by the string length between the fixed point B and the zero fret and $l_{24}$ is given by the string length between the supporting point B and the 24th fret. The 24th-fret period data $T_{24}$ corresponding to the 24th fret-position is substituted for the obtained key code X. Namely, $$T_{24} = \frac{l_{24}}{GL} \cdot T_0$$

is substituted into the following equation, $$X = \frac{24(T_0 - Tx)}{T_0 - T_{24}}$$

As a result, we obtain $$X = 24 \times \frac{T_0 - Tx}{T_0\left(1 - \frac{l_{24}}{GL}\right)}$$

In Step 19-4, the quantity $X+n_0$ (the musical scale of the concerned open-string) is obtained as the key code and then the flow is terminated.

In this manner, in the seventh embodiment, prior to performance the open-string period-data $T_0$ is extracted through the open-string picking by the pitch-extracting circuit and the processing circuit as in the fifth embodiment, and said open-string period-data $T_0$ is pre-set as the reference-pitch information in the open-string period-registers *7a* through *7f* for the first through sixth string. During performance, the pitch of the vibration of the plucked string is extracted as the performance-pitch information and said performance-pitch information is converted into the corresponding key code at real time by the key-code converting circuit 10A based on said reference-pitch information (the open-string period-data $T_0$ previously pre-set in the registers). And the operation thereafter is the same as that in the fifth embodiment.

The effects of the seventh embodiment will be described. In the seventh embodiment, the pre-setting of the open-string period-data $T_0$ obtained through the open-string picking permits the obtaining of the key code at real time by using the value of $l_{24}/l_0$ as in the third embodiment. The seventh embodiment requires only the four rules of arithmetic and requires $n_0$ the logarithmic calculation which is performed in the fifth embodiment, so that the proper key code can be easily and rapidly obtained. Furthermore, by applying the seventh embodiment, the electronic stringed instrument can be realized which has a wide compass of approximately four octaves with a limited-long fretboard as in the third embodiment.

Eighth Embodiment

The eighth embodiment of the present invention will be described referring to FIG. 20. The eighth embodiment describes the present invention which is applied to the electronic stringed instrument with the frets being aligned at an even fret interval FL and the string-length interval GL being inappropriate. The whole circuit arrangement is the same as that of the sixth embodiment. As the present invention is applied to the electronic stringed instrument with the frets being aligned at an even interval FL and the string-length interval being inappropriate, as mentioned above, the key-code calculation-process by the key-code generating circuit 10B in the eighth embodiment is different from that in the sixth embodiment. The key-code calculation-process will be described in accordance with the flow chart of FIG. 20 for calculating the key codes.

Figure 20:
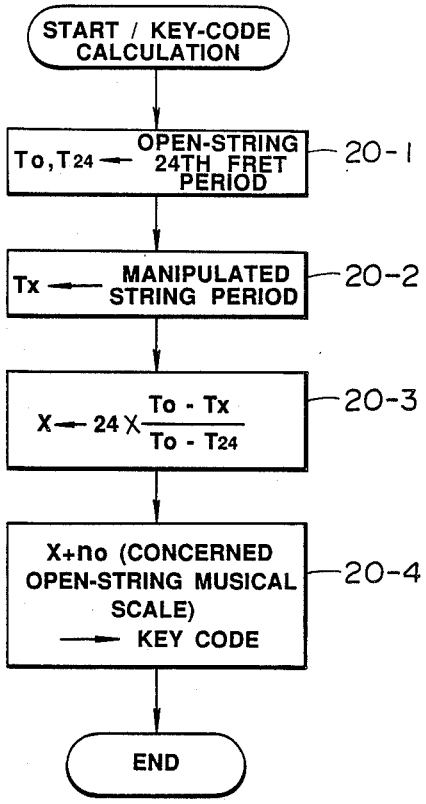
FIG. 20 is a flow chart showing a key-code calculation used in the eighth embodiment of the present invention.

FIG. 20 is useful for illustrating the key-code calculation-process which is one of the features of the eighth embodiment. In step 20-1, the open-string period-data $T_0$ and the 24th-fret period-data $T_{24}$ are previously extracted through the open-string picking and the 24th-fret picking, respectively. And these period data $T_0$ and $T_{24}$ are pre-set in the corresponding open-string period-registers *7a* through *7f* and in the corresponding 24th fret period-registers 13*a* through 13*b*. Step 20-2, the manipulated-string period-data Tx for the corresponding fret position is obtained through the actual string picking during performance and is stored in the Tx-register in the key-code generating circuit 10B. In Step 20-3, the following equation is calculated:

$$X = 24 \times \frac{T_0 - Tx}{T_0 - T_{24}}.$$

In Step 20-4, the quantity $X+n_0$ ($n_0$ is an open-string musical-scale of the concerned string) is obtained as the key-code and the flow is terminated.

In this manner, in the eighth embodiment as in the sixth embodiment, the open-string period data $T_0$ for each string are extracted through the open-string picking and the extracted data $T_0$ are pre-set in the concerned open-string period-registers 7*a* through 7*f*. The 24th-fret period data $T_{24}$ for each string are also extracted through the 24th-fret picking and said data $T_{24}$ are pre-set in the concerned 24th-fret period-registers 13*a* through 13*f*. During performance, the manipulated string-period data Tx of the picked string is obtained as the performance-pitch information as in the sixth embodiment and said performance-pitch information is converted into the corresponding key-code at real time by the key-code converting circuit 10B based on both the open-string period-data $T_0$ and the 24th-fret period-data $T_{24}$. The operation thereafter is the same as that of the sixth embodiment. the eighth embodiment is different from the sixth embodiment in that the calculation for obtaining the key code in the key-code converting circuit 10B is carried out depending on the 24th-fret period data $T_{24}$ in addition to the open-string period-data $T_0$.

The effects of the eighth embodiment will be described. The eighth embodiment is so arranged as to pre-set prior to performance the open-string period data $T_0$ and the 24th-fret period data $T_{24}$ obtained in the manner described above as the reference information into the corresponding open-string period-registers 7*a* through 7*f* and the corresponding 24th-fret period registers 13*a* through 13*f* and also as to convert at real time the performance-pitch information extracted through the octual string picking during the performance into the corresponding key code by means of the key-code converting circuit 10B depending on said reference-pitch information. Accordingly, the eighth embodiment requires no string-fret period-operation circuit and no musical-scale fret vs. period-table memories for each string, and with use of the present embodiment, an electronic stringed instrument of an electronic tuning type can be realized with a simple arrangement enabling a proper and real-time tuning.

Ninth Embodiment

Figure 21:
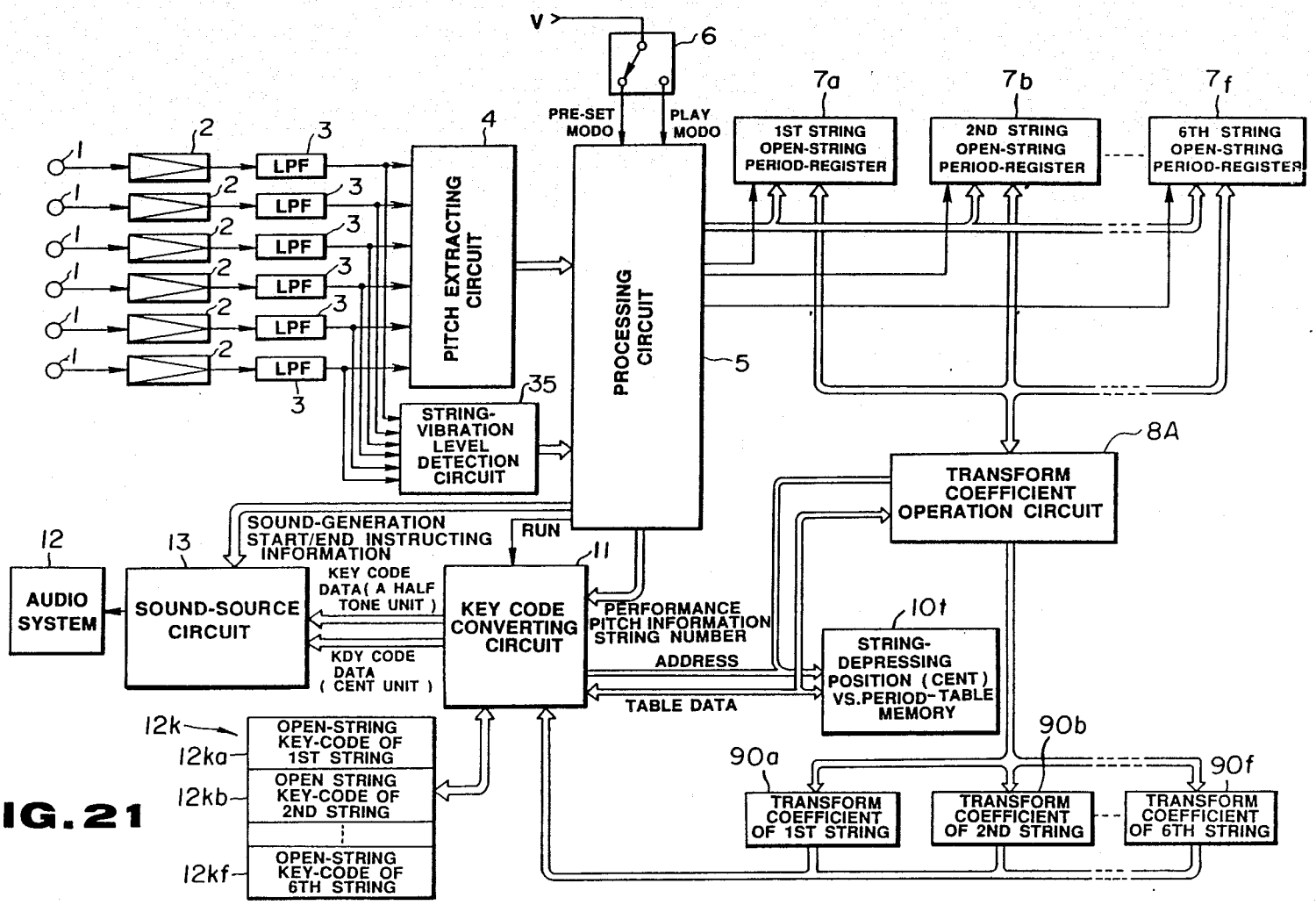
FIG. 21 is a block diagram showing a whole circuit of the ninth embodiment of the present invention.

The ninth embodiment of the present invention will be described. In the present embodiment, a sound-frequency control at a starting of the sound generation caused by the string plucking manipulation is executed in a unit of a half tone (a 100 cent unit) and the sound-frequency control after the sound generation is executed in a unit of 10 cents which is finer than a half tone. The whole circuit arrangement of the ninth embodiment is shown in FIG. 21. Like reference symbols represent like elements of the first embodiment shown in FIG. 3 and a further description thereof will be omitted.

It is a feature of the arrangement of the present embodiment that said arrangement is provided with the first-string open-period register 7*a* through the sixth-string open-period register 7*f*, a transform-coefficient operation-circuit 8A, first-string transform-coefficient register 90*a* through a sixth-string transform-coefficient register 90*f*, and a string-depressing position vs. period-table memory 10*t*, all of which are used in the pre-set mode. The first-string open-period register 7*a* through the sixth-string open-period register 7*f* which are provided for each of the strings 107 from the first string to the sixth string serve in the pre-set mode to store open-string period-data TM which are measured through the string-plucking manipulation with the string being depressed at a predetermined position or at an open-string fret-position (the zero fret position) in the present embodiment, which restricts a vibrating-string length to a predetermined length. For example, when the pitch-extrating circuit 4 extracts a certain pitch through the open-string picking of a given string 107, the processing circuit 5 writes the open-string period-data TM of the string 107 as a string information into the corresponding open-period register 7*a* through 7*f*.

The transform-coefficient operation-circuit 8A compares each of the open-string period-data TM stored in the open-period registers 7*a* through 7*f* with the period data TO for the open string which is stored at the leading position in the string-depressing position vs. period-table memory 10*t* and calculates the ratio of the two data TO/TM, thereby writing the result into the first-string transform-coefficient register 90*a* through the sixth-string transform-coefficient register 90*f*. In this manner, the measured period TM for each string are confirmed as the periods for each open-string.

The contents of the string-depressing position vs. period-table memory 10*t* will be described referring to FIG. 22. In the table shown in FIG. 22, X cent represents string-depressing positions and for example. 0 cent represents the zero fret position (open-string fret position), 100 cents represent the first fret-positon, 200 cents represent the second fret-position, and so on. Th resolution for the string-depressing position is of 10 cents in the example of FIG. 22, so that the address 0 in the table corresponds to the open-string fret-position and the address 10 in the table corresponds to the first fret-position The data in the table are given in the Y-period column where the period data Y ($=1000\times2^{-=/1200}$) corresponding to each string-depressing position X are stored. It relates to 24 frets being aligned on the finger-board of the electronic stringed instrument of FIG. 1 that the range for the string-depressing position varies from the zero fret-position (open string) to the 28th fret-position. Taking into consideration a raise in the vibration frequency of the string 107 caused by the aiming operation of the tremolo arm 103 or by the bending operation to the string 107, the table is arranged larger in the fret number than the finger board by four frets.

In FIG. 21, the key-code converting circuit 11, which is used in the play mode, serves to convert the period measured from the vibrations of each string 107 generated by the sting-plucking operation into the key-code data (sound-frequency defining data) for defining the period for the tuned string, thereby performing the tuning control. In detail, the key-code converting circuit 11 reads out the string information obtained in the pre-set made or the transform-coefficient data stored in the transform-coefficient registers 90*a* through 90*f* in this case and multiplies the measured period by said transform coefficient, thereby converting the period. This converted period serves as a key for searching through the string-depressing position vs. period-table memory 10*t* by the key-code converting circuit 11. Namely, the table address having the converyed period data represents the string-depressing position of the string relating to the measured period. The key-code converting circuit 11 adds the key code relating to the tuned open-string (the key code stored in open-string key-code registers 12K (12K*a* through 12K*p*) to the string-depressing position detected by searching through the table, thereby generating the required key-code data.

In the present embodiment, the resolution of the tuning key-code generated by the key-code converting circuit 11 is made different between at starting of the sound generation and thereafter. In detail, the keycode converting circuit 11 generates the key code with the resolution of a half tone (100 cents) at starting the sound generation and also generates the key code with the resolution of 10 cents which is finer than 100 cents (and is equal to the resolution of the table memory 10). The processing circuit 5 sends a RUN-FLAG signal to the key-code converting circuit 11 for determining which of the resolutions should be selected. The RUN-FLAG signal takes logic "0" at starting of the sound generation and takes a logic "1" during the sound generation. The data concerning the string number is transferred together with the measured period data (the performance pitch information) from the processing circuit 5 to the key-code converting circuit 11, for said circuit 11 to select the transform-coefficient registers 90*a* through 90*f* and the open-string key-code registers 12*a* through 12*f*.

The data format of the key code to be registered in the open-string key-code register 12K will be described referring to FIG. 23.

Figures 23A, 23B:
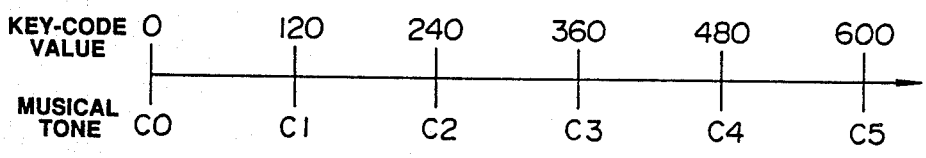
FIG. 23*a* is a table showing contents of an open-string key-code register shown in FIG. 21.
FIG. 23*b* is a chart showing a data format of key code.

The present embodiment intends to obtain under a proper tuning condition the open-string sound-frequency which is the same as that obtained by conventional six-string guitars. Accordingly, the musical tone generated from the first open-string under the properly tuned condition represents E4, the musical tone from the second string represents B3, the musical tone from the third string represents G3, the musical tone from the fourth string represnets D3, the musical tone from the fifth string represents A2, and the musical tone from the sixth string represent E2. The key codes corresponding to these musical tones are stored in the open-string key-code register as shown in FIG. 23*a*. These key codes represent musical tones in terms of numerical value which varies linearly from the value "0" for the key code corresponding to the musical tone CO through the value 120 at one octave as shown in FIG. 23*b*. The key code KC is given by the following logarithm euation:

$$KC = 120 log_2(K \times F)$$

where subject to F is frequency, K is a constant and the frequency F at the musical tone CO is 16.352 Hz., then KF=1. When the musical tone is expressed in logarithm, the key-code range covering the audible-frequency range can be made narrow, so that the data expression in logarithm makes the data length short, permitting the data compression. Therefore, various electronic instruments or the interfaces between musical instruments (e.g., MIDI standard) employ the data expression in logarithm. The data expression, however, is not limited to the above expression and can employ an arbitrary expression of the musical tone.

In FIG. 21, the key code for the tuned string generated by the key-code converting circuit 11 is supplied as the musical tone defirring data to the sound-source circuit 13. The sound-source circuit 13 is further supplied from the processing circuit 5 with a signal indicating start and/or end of sound generation (including data of the peak level of the string vibration as a touch parameter of the plucking strength at starting of the sound generation). The sound-source circuit 13 produces at starting of the sound generation frequency signals or phase signals from the key-code data of a half-tone unit supplied from the key-code converting circuit 11, thereby forming musical tones having the sound frequency which is designated by producing the musical-tone waveform of each phase. When the vibration frequency of the string 107 is changed during the sound generation, the sound-source circuit 13 forms other musical tones having a changed and other sound frequency, in response to the key code having the 10-cent resolution newly supplied from the key-code converting circuit 11. The musical tones formed in the sound-source circuit 13 are supplied to the audio system 12 and are output therefrom.

The operation of the ninth embodiment having the arrangement mentioned above will be described hereinafter.

Figure 24:
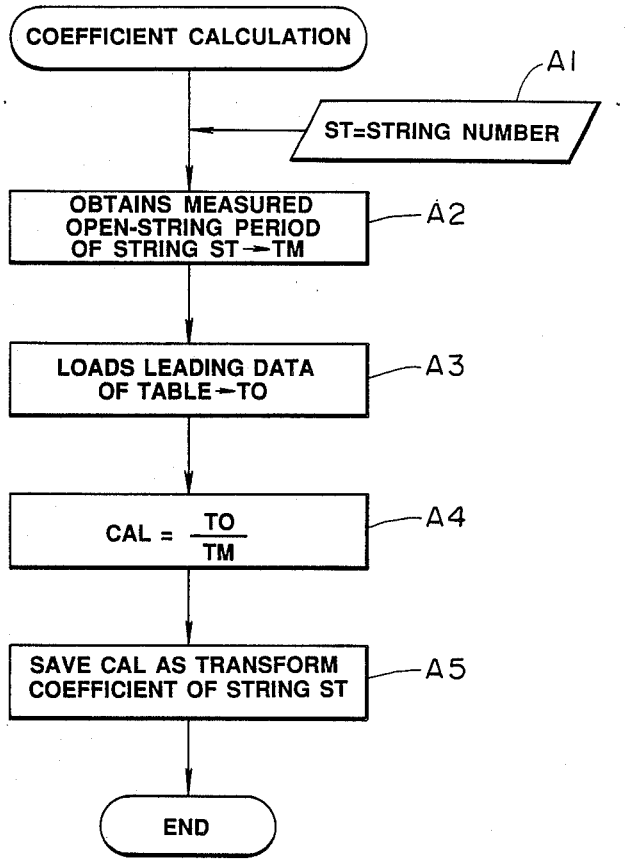
FIG. 24 is a flow chart showing an operation of a transform-coefficient operation circuit shown in FIG. 21.

First, a pre-set mode will be illustrated, in which the tuning conditions of each string are examined. The pre-set mode is set by bringing the mode switch 6 to the pre-set position. In the pre-set mode, the player plucks each string 107 with the string being open. As a result, the pitch-extracting circuit 4 extracts the open-string period of each string and sends the extracted period to the processing circuit 5. The processing circuit 5 stores directly or indirectly the open-string period supplied from the pitch-extracting circuit 4 in the open-string period-registers 7*a* through 7*f*. After measuring the open-string period, the transform-coefficient operation-circuit 8A starts its operation to calculate the transform-coefficient in accordance with the flow shown in FIG. 24. In Step A-2, the operation circuit 8 accesses the open-string period-registers 9*a* through 9*f* of the string ST to read out the data TM. In Step A-3, the operation circuit 8A accesses to the leading address in the string-depressing position vs. period-table memory 10*t* to load the open-string period TO stored in the table. The operation circuit 10 calculates the ratio CAL of the measured open-string period TO and the open-string period TM stored in the table (Step A-4), and stores the result as the transform coefficient of the string, in the transform-coefficient registers 90*a* through 90*f* (Step 9-5).

As will be understood from the above description, in the pre-set mode the open-string condition of each string 107 is discriminated through the measured open-string period-data or the form of the transform-coefficient data. The transform coefficient is used in the play mode to transform the measured period into the corresponding period in the string-depressing position vs. period-table memory 10*t* for detecting the string-depressed position. Note that the calculation of the transform coefficient may be executed in the play mode.

Figure 25:
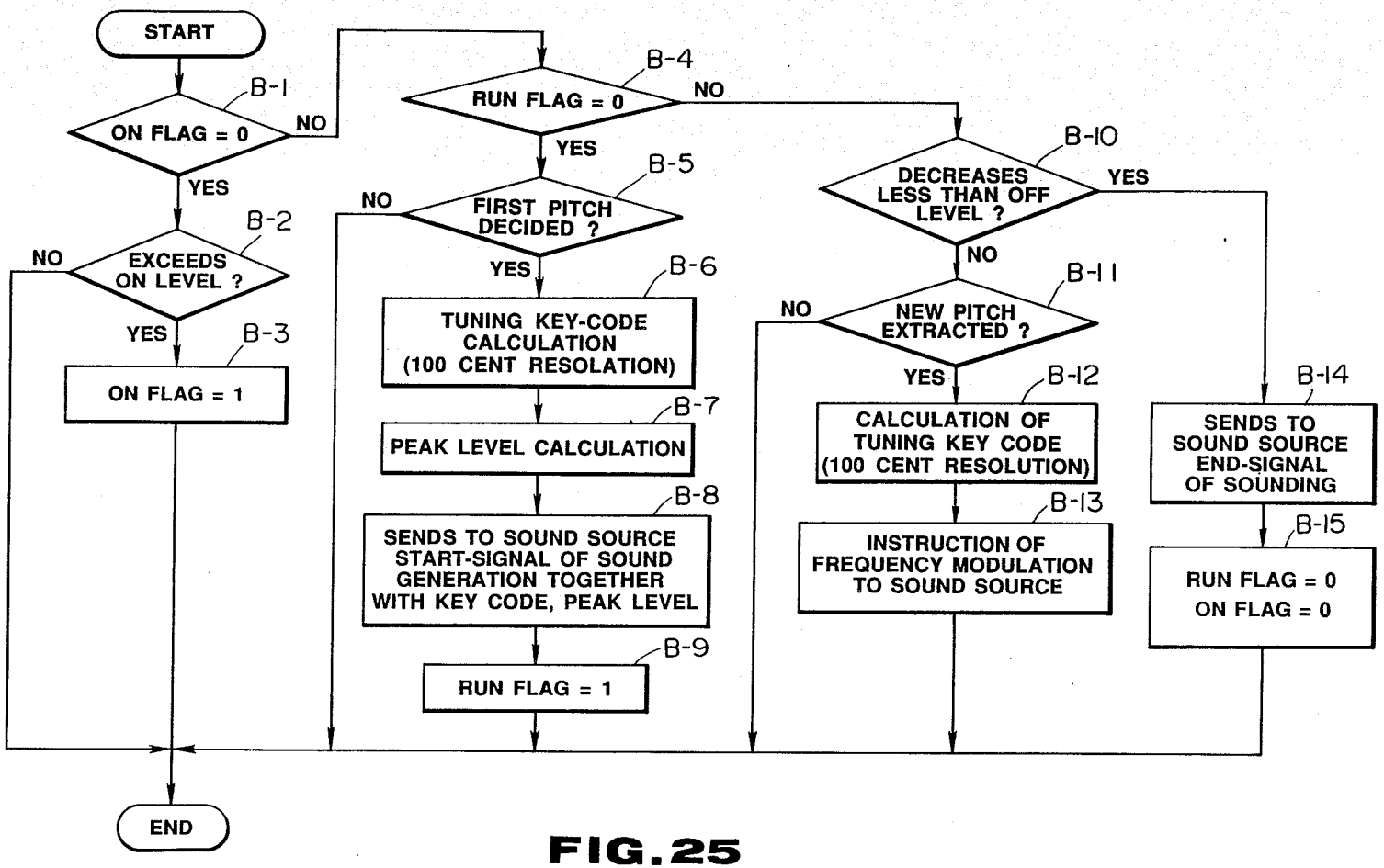
FIG. 25 is a flow chart showing an operation of the ninth embodiment in its play mode.
Figure 26:
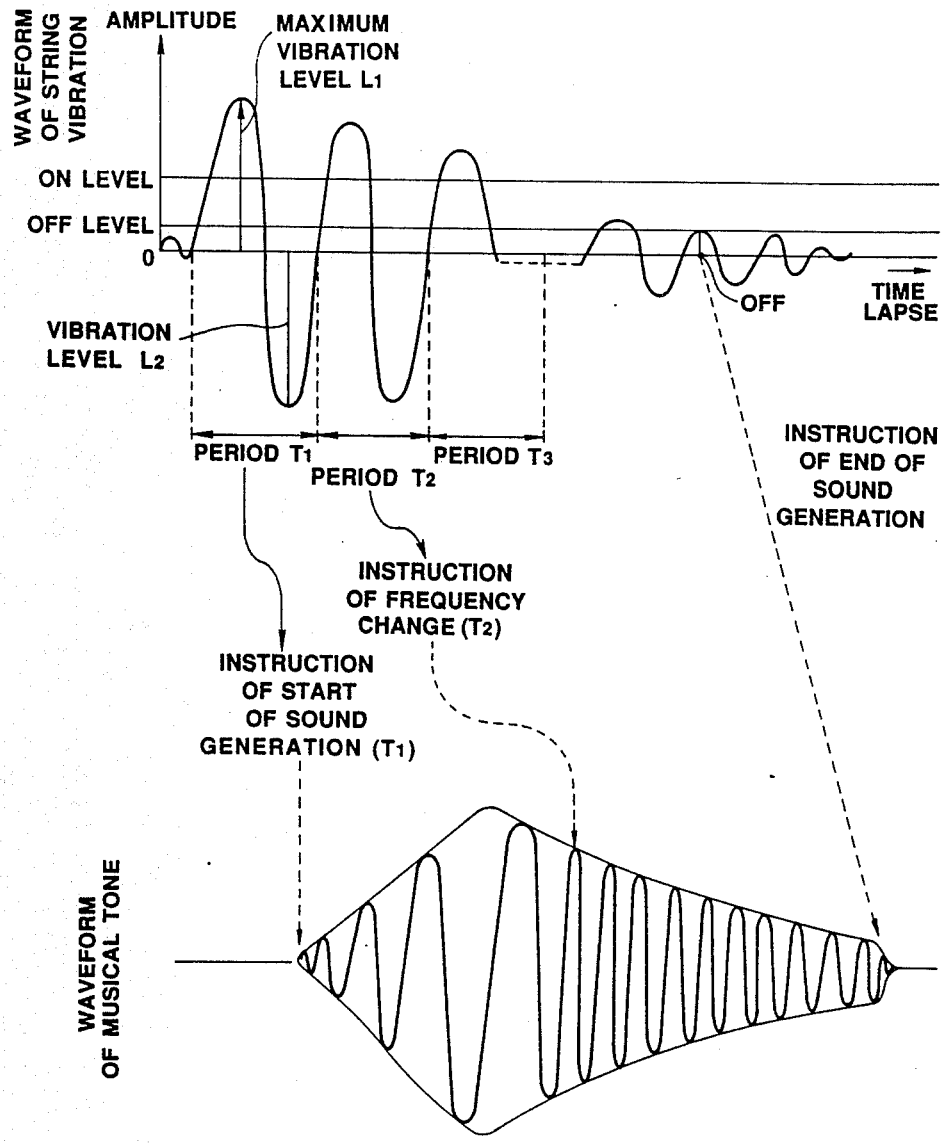
FIG. 26 is a time chart showing a string-vibration waveform, useful for description of the flow chart shown in FIG. 25.

The electronic tuning control in the play mode will be described. The operation flow of the present embodiment in the play mode is shown in FIG. 25. The flow of FIG. 25 shows the operation with respect to an arbitrary string. FIG. 26 shows the waveform of the string vibration caused by the plucking manipulation to an arbitrary string and the waveform of the musical tone produced in the sound-source circuit 13 based on said string vibration. While the string 107 stands still, ON FLAG=0, then the check by the processing circuit 5 in step B-1 is established. As the level of the string vibration given by a string-vibration detecting circuit 35 is equal to zero or is closely equal to zero, it is confirmed in Step B-2 that the level of the string vibration does not reach a predetermined ON level. The string-plucking manipulation to a string causes a string vibration shown in FIG. 26. The vibration level L1 shown in FIG. 26 is higher than the ON level. Accordingly, the check in Step B-2 is established at the path following the cause of the vibration level L1. In Step B-3, ON FLAG is raised for starting of sound generation. When the string vibrates, the pitch extracting circuit 4 calculates the period of said vibration and the processing circuit 5 receives the result to confirm the initial pitch (period). Namely, if the check in Step B-1: ON FLAG=0 is not established and the check in Step B-4: RUN FLAG=0 is established, then the operation advances to Step B-5. In Step B-5, the processing circuit 5 examines whether or not the initial pitch is determined. If the period Tl shown in FIG. 26 is a determined initial period, then the check in Step B-5 is established on the path after said period Tl is obtained. In this case, the processing circuit 5 sends the performance-pitch information together with the string number, RUN FLAG to the key-code converting circuit 11. As a result, as shown in Step B-6, the key-code converting circuit 11 generates a tuning key-code of a half-tone unit (100 cent unit). Furthermore, the processing circuit 5 generates a peak of the vibration level as the touch parameter as shown in Step B-7 (in FIG. 26(*a*), either the vibration level L1 or L2, whichever is larger).

The key code and the peak level generated in this manner are sent together with a sound-starting signal to the sound source 13 as indicated in Step B-8 and then musical tones having a tuned sound frequency are produced in the sound-source circuit 13 as shown in FIG. 26. The processing circuit 5 raises RUN FLAG to indicate that the sound of the musical tone is being output (in Step B-9).

Accordingly, after start of sounding, the check in Step B-4, RUN FLAG=0 is not established, and the processing circuit examines in Step B-10, whether or not the vibration level decreases less than the OFF level. While the vibration level is equal to or more than the OFF level, the processing circuit 5 examines in Step B-11, if the period is changed. If the period $T_2$ shown in FIG. 26 is the changed period, then the condition in Step B-11 is established and the processing circuit 5 sends the new period $T_2$ together with the string number ST, RUN FLAG to the key-code converting circuit 11. When received the above information, the key-code converting circuit 11 calculates the key code with the resolution which is higher than that at the start of sounding by 10 cents (Step B-12). The processing circuit 5 supplies the key code of the high resolution to the sound-source circuit 13 (in Step B-13), thereby allowing a fine pitch-alteration after the start of sounding.

The string vibration once generated is attenuated with time lapse after the string plucking manipulation. The vibration level decreases less than the predetermined OFF level at the time of OFF as shown in FIG. 26. At this time, the condition indicated in Step B-10 of the flow of FIG. 25 is established, and the processing circuit 5 sends a sound-terminating signal to the sound-source circuit 13 to terminate the sounding. Furthermore, the processing circuit 5 resets the RUN FLAG and the ON FLAG to indicate that the string 107 goes still.

Figure 27:
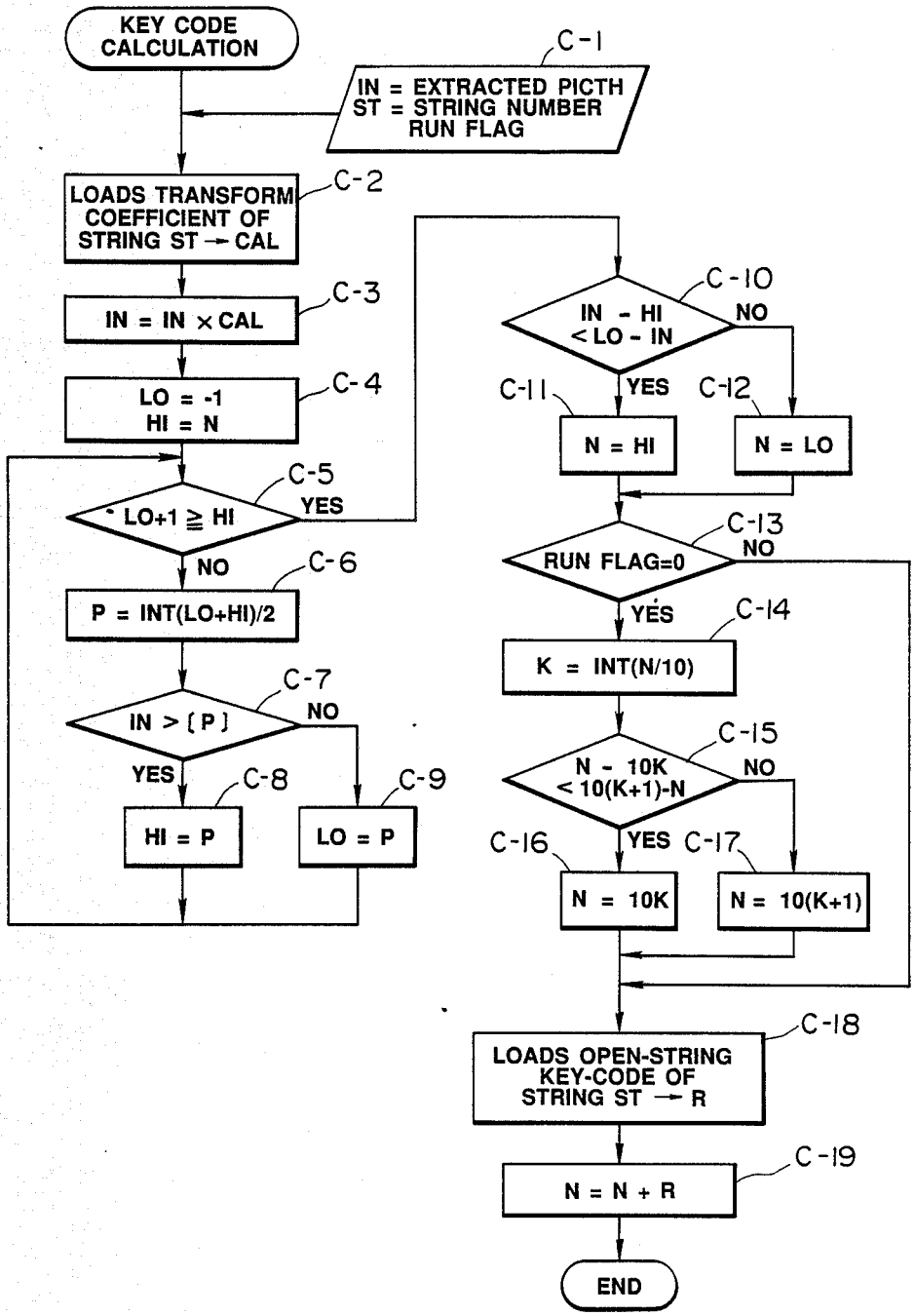
FIG. 27 is a flow chart showing an operation of a key-code converter circuit shown in FIG. 21.

The detail of the processing by th key-code converting circuit 11 executed in Steps B-6 and B-12 of FIG. 25 is shown in FIG. 27. The extracted pitch (the measured period) IN, the string number ST and RUN FLAG shown in Step C-1 are the data supplied from the processing circuit 5. Received these data, the key-code converting circuit 11 loads the contents with respect to the string ST in the transform-coefficient registers 90*a* through 90*f* into a CAL-register in Step C-2. In Step C-3, the key-code converting circuit 11 obtains a transform period IN by multiplying the measured period by the transform coefficient CAL. The address of the transform period IN indicates the string-depressed position. Accordingly, in the following Steps C-4 through C-12, the string-depressing position vs. period-table 10*t* is searched to detect the address which has the period data most accordant with the transform period IN. As shown in FIG. 22, the contents of the string-depressing position vs. period-table memory 10*t* degreases as the address increases. Applying the above, the table memory 10*t* is searched in the following manner as shown in FIG. 27. Namely, in Step C-4, "−1" is initially set to a L0 register and the size N of the table memory 10*t* (280 in FIG. 22) is initially set to an H1 register, respectively. The value of L0 and a half of the value Hl serve a pointer for the table memory 10 (in Step C-9), and the period data [P]in the address indexed by said pointer P is compared with the transform period IN in Step C-7. If the transform period IN is longer than the period data [P], the required address may be at a lower address and if the transform period IN is shorter than the period data [P]. The required address may be at a higher address. Accordingly, in Step C-1, P is substituted for Hl in the former case, and P is substituted for L0 in the latter case. As a result, every processing from C-5 to C-9 makes the difference between Hl and L0 half and in a short time, in Step C-5, L0+1 ≧ Hl will be established. At this time, the value of Hl or L0 may indicate the address having the period data which is closest to the transform period amoung those stored in the table memory 10*t* or said value may indicate the string-depressing position providing the measured period. Through Steps C-10 to C-12, it is examined which addresses Hl or L0 is closer to the transform period and the result thereof is stored in the N-register.

The value of the N-register obtained in the above mentioned processing represents the string-depressing position of the string ST in a 10-cent unit of the resolution of the table memory 10*t*.

As mentioned above, in the present embodiment, the key code is generated with the high resolution of a 10-cent unit during the sounding, but at the starting of the sounding, the operations by the tremoro arm or choking operation is not executed, so that the key code is obtained with the low resolution of a half-tone unit or a 100-cent unit. In order to realize the above mentioned, in Step C-13, RUN FLAG is examined to decide whether it is the staring of sounding or not, and if it is the starting of sounding, the string-depressing position N of a 10-cent resolution is converted into the string-depressing position of a half-tone unit corresponding to the fret in the following Steps C-14 through C-17. That is, in Step C-14, a fret K is obtained with the figures below 100 being disregarded in accordance with the equation. K=INT(N/100). In Step C-15, it is examined to which fret K or K+1 the string-depressing position N of a 10-cent resolution is closer and the value 10K corresponding to the closer fret K is stored in the N-register in Steps C-16 and C-17.

In the manner mentioned above, the string-depressing position N providing the measured period IN is obtained with the 10-cent resolution during the sounding and with the 100-cent resolution at the starting of the sound generation.

Accordingly, in the following Step C-18, the tuned open-string key-code for the string ST is read out from the open-string key-code register 12K and the key-code register 12K and the key-code N representing the tuning period with respect to the measured period is obtained by adding the read out value R to the string-depressing position N in Step C-19.

As will be clearly appreciated, in the ninth embodiment, the open-string state with respect to tuning for each string is examined and decided by plucking each of the strings 107 with the open-string fret-position in the pre-set mode of the electronic stringed instrument. And in the play mode, the measured period is transformed into the period on the string-depressing position vs. period-table memory 10*t* based on the result of the decision obtained in the pre-set mode in order to convert the measured period with respect to the string vibration of the string 107 which is plucked at an arbitary fret position into the key code indicating the properly tuned period. The string-depressing position is obtained by searching through the table memory 10*t* and the key code of the open string is added to said string-depressing position. The sound frequency control in the sound-source circuit 13 is performed in accordance with the key code, so that musical tones of properly tuned sound frequency can be always obtained regardless of the setting state of the strings 107.

Tenth Embodiment

Figure 28:
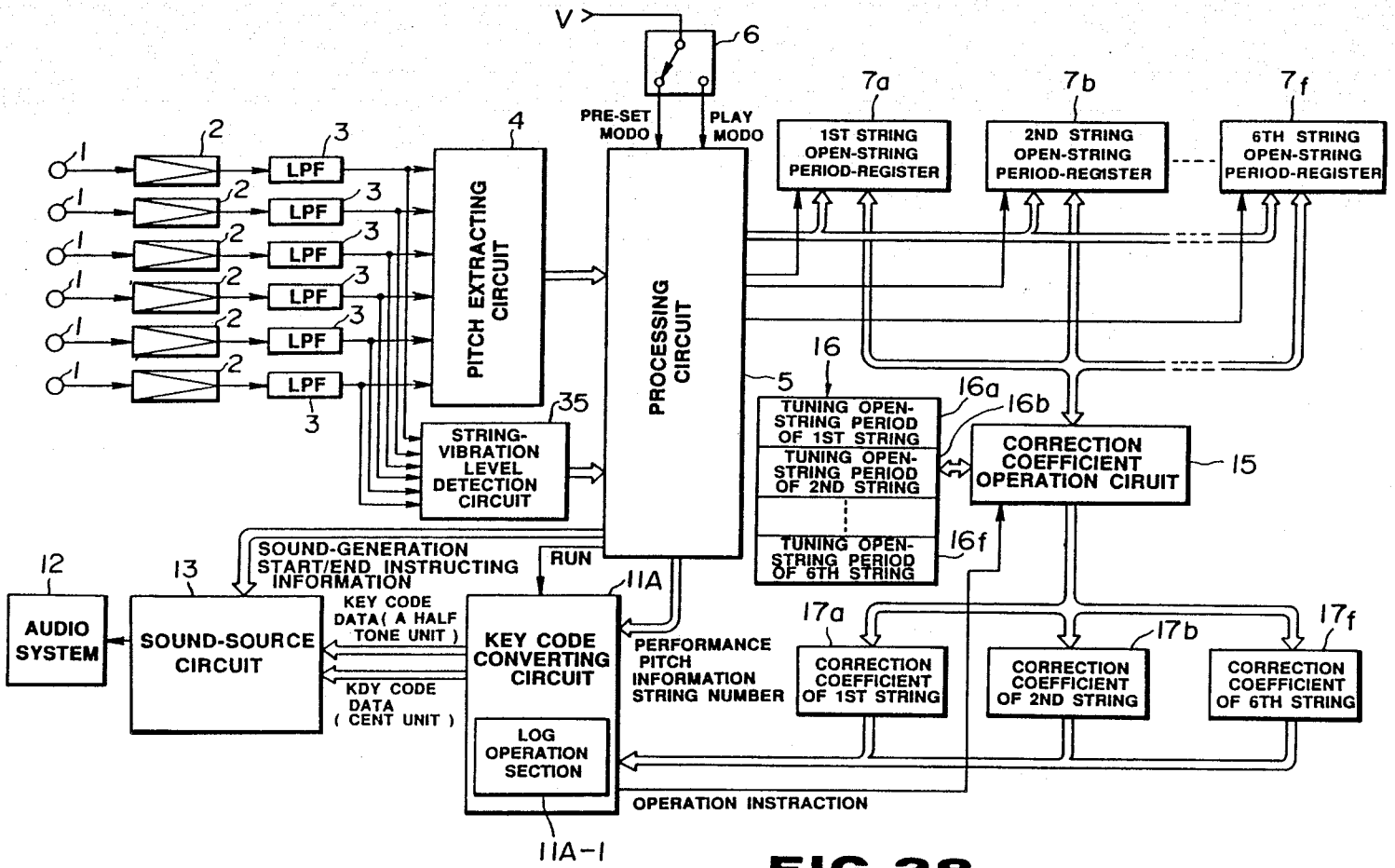
FIG. 28 is a block diagram of a whole circuit of the tenth embodiment.

The tenth embodiment of the present invention will be described. In the present embodiment, the logarism processing is directly executed for generating the key code. FIG. 28 shows the whole circuit arrangement of the tenth embodiment. In the present embodiment, like reference symbols represent like elements in FIG. 21 and a further description thereof will be omitted.

Figures 29, 31:
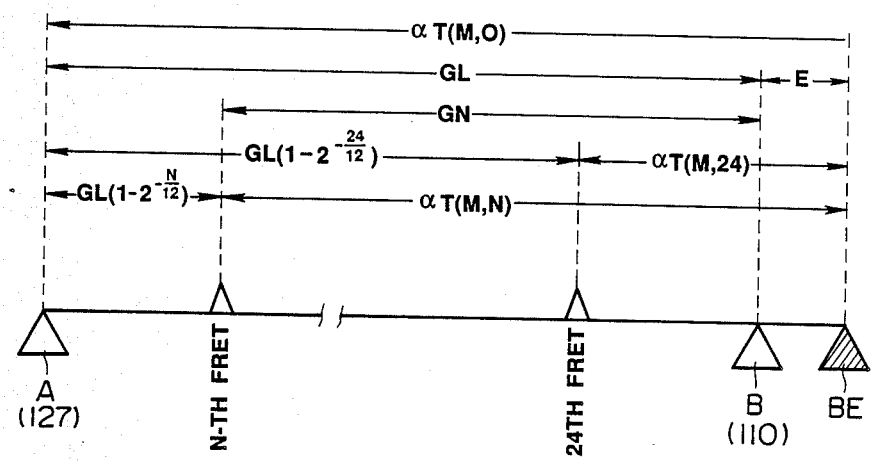
FIG. 29 is a table showing contents of a tuning open period-register shown in FIG. 28.
FIG. 31 is a chart relating to the eleventh embodiment and is useful for description of an electronic tuning for a string, both ends of which are champed at normal positions.

A calibration-coefficient operation-circuit 15 corresponds to the transform-coefficient operation-circuit 8A in the ninth embodiment. Said circuit 15 reads out the measured open-string periods stored in the open-string period-registers 7*a* through 7*f* to calculate the ratio of said measured open-string period to the reference open-string period, and stores the calculated ratio (a calibulation coefficient) in the first through sixth string calibration-coefficient registers 17*a* through 17*f*. Differring from the tranform-coefficient operation-circuit 8A in the ninth embodiment, the calibration-coefficient operation-circuit 15 is arranged to operate in the play mode in response to the operation-instruction from the key-code converting circuit 11A. The period for the properly tuned string 107 is used as the reference open-string period. The open-strings period-data of the tuned strings 107 are stored in the first through sixth tuned open-string period-registers 16 (16*a* through 16*f*). As shown in FIG. 29, the first open-string period is 3034 μsec., the second open-string period is 4050 μsec., the third open-string period is 5102 μsec., the fourth open-string period is 6811 μsec., the fifth open-string period is 9091 μsoc., and the sixth open-string period is 12,135 μsec.

The key-code converting circuit 11A in the tenth embodiment has a logorithm-operation section 11A-1, which directly calculates logarithm by an approximate multiterm operation. Accordingly, the tenth embodiment requrires no logarithm-transform table such as the string-depressing position vs. period-table memory 10*t* of the ninth embodiment. The key-code converting circuit 10A in the tenth embodiment produces the key code with the resolutin of a half-tone (100 cents) at starting of sound generation, and the key code with the resolution of one cent during sounding. The format of the key code is so selected that one octave is 120, value 1 per cent, and the key code for the musical tone CO is zero. Hence, the key code KC for a frequency F is given by $$KC = 1200 \log_2 (F/K)$$

where K is a constant corresponding to a frequency 16.352 Hz of the musical tone CO.

The operation of the present embodiment will be described. In the pre-set mode, as in the ninth embodiment, the open string is plucked for each string 107 and the pitch-extracting circuit 4 extracts the open-string period for each string, and then the processing circuit 5 stores the results thereof in the first through sixth open-string period-registers 7*a* through 7*f*, respectively. But at this time, the calibration coefficient is not calculated.

Figure 30:
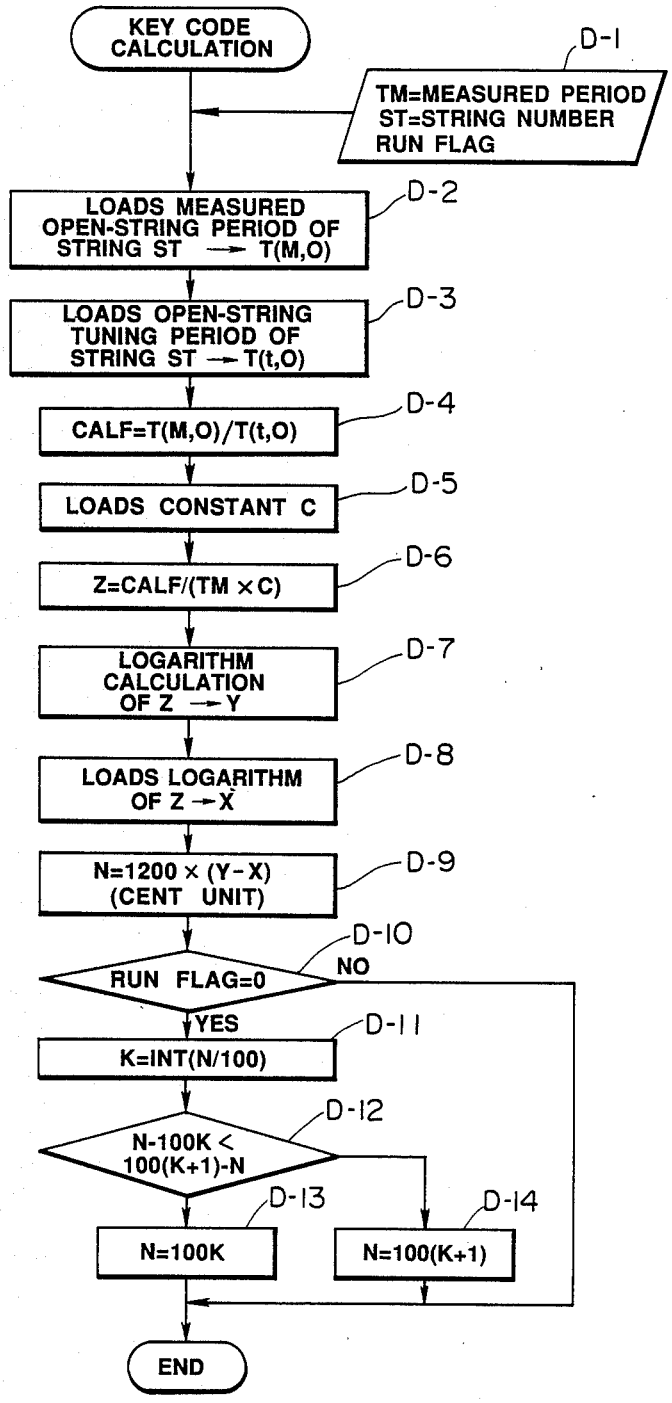
FIG. 30 is a flow chart showing an operation of a correction-coefficient operation circuit and a key-code converter circuit shown in FIG. 28.

In the play mode, the operation of the tenth embodiment is the same as that of the ninth embodiment except for the key-code calculation. The detail of the key-code calculation in the tenth embodiment is illustrated in FIG. 30.

The data, TM, ST, and RUN FLAG shown in D-1 represent the measured period, the string number, and the flag during sounding, respectively, which are supplied from the processing circuit 5 to the key-code converting circuit 11A. Receiving these data, the key-code converting circuit 11A instructs the calibration-coefficient operation-circuit 15 to calculate the calibration coefficients. In step D-2, the calibration-coefficient operation-circuit 15 loads the measured open-string period (which indicates the string-state detected in the pre-set mode) of the string ST from the selected registers 7*a* through 7*f* to T(M,0) and in Step D-3, the circuit 15 also loads the tuned open-string period of the string ST from the selected register 16 to T(t,0). The circuit 15 calculates the ratio of T(M,0) to T(t,0) and loads the result of the calculation in the calibration-coefficient register CALF (17*a* through 17*f*) of the string ST. In the meantime, the key-code converting circuit 11A loads the constant C and calculates CALF/(TM x C) to load the result in Z-register in Step D-6. In Step D-7, the logarithm-operation section 11A-1 calculates a multi-term formula to obtain the logarithm of Z and loads the calculation result in Y-register. And then the key-code converting circuit 11A-1 loads the logarithm of 2 (log 2) in X-register in Step D-8 and obtains the key code N with the resolution of a cent unit from N=1200×(Y-X) in step D-9.

Through Steps from D-2 to D-9, the key code N indicating the sound frequency of the tuned string can be obtained with the resolution of a cent unit. Namely, the key code N is given by $$N = 1200 \log 2 \left\{ \frac{T(M, 0)}{T(t, 0) \times TM \times C} \right\}$$

where

T(M,0): open-string period measured with the string being open

T(t,0): open-string period of the properly tuned string

TM : measured period

C : constant

For one example, it is assumed that the period 3304 μsec. is measured as the open-string period of the first string in the pre-set mode. The tuned open-string period of the first string is 3034 μsec. If the measured period, 1500 μsec. is obtained for the first string, the key code N of the corresponding string propely tuned is given by $$N = 1200 \times \log2\left(\frac{3304}{3034} \times \frac{61154.5}{1500}\right)$$
$$\approx 6567 \text{ (cent)}$$

where the constant is $16{,}352 \times 10^{-6}$ (1/c=61154.5) Namely, the key code represents the sound frequency that is higher than the musical tone F5 by 67 cents.

The processings in Step D-10 through D-14 are similar to those in Steps C-13 through C-17 shown in FIG. 27. When RUN FLAG =0 or at starting of sound generation, the initial key code is calculated with the resolution of a half tone (100 cents). In the above example, the initial key code is given by N=6600 cents and as a result, F#5 is designated.

In this manner, in the tenth embodiment, the logarithm-transform table is not required for producing the key code, so that the memory capacity therefor can be saved.

Eleventh Embodiment

The eleventh embodiment of the present invention will be described referring to FIG. 31. The arrangement of the present embodiment permits the musical-tone control with the sound frequency of the properly tuned state, even in case that the string-supporting portions for supporting both ends of a string are not mounted at the normal positions.

The ninth and tenth embodiment are arranged on the assumption that the ratio of the vibration length GL of the open string and the vibration length GN of the string which is depressed at a predetermined fret position or the ratio of the periods of the vibrations of the string lengths GL,GN is constant and known. The above assumption is not estabished in case that the string-supporting portion 110 or 127 is not positioned at the normal position for same reason. In this case, the periods measured at two string-depressing positions in the pre-set mode indicate that the string-supporting portions 110 and/or 127 are positioned out of place and allow the electronic-tuning control of musical tones in the play mode. The principle thereof will be described referring to FIG. 31. In FIG. 31, A and BE represent the fulcrums of the string-supporting portions 110 and 127. FIG. 31 shows that the fulcrum BE is out of the normal position B (fulcrum B). Namely, the distance GL between the fulcrums A and B is the normal length of the open string and the fulcrum BE is positioned out of the normal fulcrum B in the plus direction by the difference E. In this case, it is assumed that the open-string fret-position and the 24th-fret position are selected for measuring the periods in the pre-set mode. The period measured at the open-string fret-position is indicated by T(M,0) and the period measured at the 24th-fret position is indicated by T(M,24) in FIG. 31. As the measured open-string period T(M,0) is measured with the open-string length (GL +E), the period and the string length are proportional to each other. The period T(M, 24) measured at the 24th-fret position is proportional to the string-length between the 24th-fret position and the fulcrum BE. As the string vibrates with teh string length longer than the normal length, the ratio of the measured open-string period T(M,0) and the measured 24th-fret period T(M,24), or T(M,0)/T(M,24) will be smaller than 4. Under the string state, if the relationship between an arbitrary fret N and the measured period T(M,N) can be discriminated, then the electronic-tuning is possible. In accordance with the rule between the fulcrum A at the normal position and the fret interval, the distance from the fulcrum A to the N-th fret is given by GL($\mathbf{1}-\mathbf{2}^{-N/12}$), and the distance form the fulcrum A to the 24th fret is also given by GL($\mathbf{1}-\mathbf{2}^{-24/12}$). The latter distance, GL($\mathbf{1}-\mathbf{2}^{-24/12}$) is proportional to the difference between the open-string period T(M,0) measured in the pre-set mode and the measured 24th-fret period T(M,24), and the distance GL($\mathbf{1}-\mathbf{2}^{-N/12}$) is proportional to the difference between the measured open-string period T(M,0) and the measured N-th fret period T(M,N). Hence, $$\frac{T(M,0) - T(M,N)}{T(M,0) - T(M,24)} = \frac{1 - 2^{-N/12}}{1 - 2^{-24/12}} = \frac{1 - 2^{-N/12}}{1 - 2^{-2}}$$

so that the fret position N is given by $$N = -12 \log2\left[1 - (1 - 2^{-2}) \times \frac{T(M,0) - T(M,N)}{T(M,0) - T(M,24)}\right]$$

The inside of the brackets []represents the ratio of the open-string frequency to be obtained for the proper string length GL and the frequency for the N-th fret. The key code which is the same as that of the embodiment will be obtained by adding the key code of the open string to N. In case that the fulcrum A is also positioned out of place, three periods are measured at three fret positions including the open-string position in the pre-set mode. For example, if T(M,1) represents the period for the first fret and T(M,24) represents the period for the 24th fret, then the following relationship betwen these data and the measured period T(M,N) for the N-th fret (N >0) is established in accordance with the rule of the fret interval:

$$\frac{T(M,1) - T(M,N)}{T(M,1) - T(M,24)} = \frac{2^{-1/12} - 2^{-N/12}}{2^{-1/12} - 2^{-24/12}}$$

Then, the fret position is given by $$N = -12 \log2\left[2^{-1/12} - (2^{-1/12} - 2^{-24/12}) \times \frac{T(M,1) - T(M,N)}{T(M,1) - T(M,24)}\right]$$

Accordingly, the period T(M,N) measured in the play mode is compared with the open-string period T(M,0) measured in the pre-set mode and if both the periods coincide with each other, the string-depressing position N is 0 (open-string position). Meanwhile, if said periods do not coincide with each other, the string-depressing position N can be obtained by substituting the measured period T(M,N) into the above mentioned equation N.

Some electronic stringed instruments have a fingerboard on which the frets are aligned at even intervals for a easy fingering-manipulation at a high sound-frequency region. The present invention is applicable to these electronic stringed instruments, where a linear (proportional) relationship is established between the measured periods and the string-depressing positions. Namely, the equation $$N = 24 \times \frac{T(M, 0) - T(M, N)}{T(M, 0) - T(M, 24)}$$

is established between T(M,0), T(M,24) and T(M,N). (If the string length GL is constant, T(M,24) can be calculated from T(M,0).) Accordingly, the logarithm transform is not required to obtain the string-depressing position N from the measured period T(M,N).

Modification

Although the invention herein has been described with reference to particular embodiments, it is to be understood that the present invention is in no way limited to the illustrated embodiments and that various modifications may be made in the embodiments.

In the initial setting operation of the first through eighth embodiments which is executed prior to performances for pre-setting the reference-pitch information, the open-string period data $T_0$ obtained through the open-string picking of each string or the 24th-fret period data $T_{24}$ obtained through the 24th-fret picking are pre-set, but other fret, for example, the twelveth fret between the open-string fret and the 24th fret may be selected as a particular reference fret, and the twelveth fret period data $T_{12}$ which is obtained through picking of the string depressed at the twelveth-fret position may be pre-set in the corresponding twelveth-fret period-register. Furthermore, the more precise fret-period data may be obtained by means of the arrangement in which fret-position registers ar provided for each fret of the strings and all of period data from the open-string period data $T_0$ to the period data $T_n$ corresponds to all of the frets are pre-set in said registers, said period data being obtained through picking of each string which is individually depressed at each fret. Another modification may be so arranged that the twelveth-fret period data $T_{12}$ obtained through the twelveth-fret picking is previously pre-set and the processing circuit (CPU) allots the fret-period data to each of the frets other than the twelveth fret in accordance with said twelveth-fret period-data $T_{12}$ and pre-sets these data.

In the ninth and tenth embodiments, the key code for defining the sound frequency is supplied to the sound source circuit 13 in the format that the properly tuned periods or frequencies are transformed into logarithms. Instead of this, the key codes in other format may be generated for the data compression by means of the table means which is realized by a transform memory or an encoder. Or the key code directly indicating the properly tuned frequency or period may be used. In this case, the process for the logarithm transform is not required in the key-code converting circuit. For instance, the key code KC expressed in frequency can be computed from the following equation;

$$KC = \frac{T(M, 0)}{T(t, 0) \times TM}$$

where

T(M,0) : open-string period measured in the preset mode

T(t,0) : open-string period of the properly tuned

TM : period measured in the play mode

The sound-source circuit 13 can generate phase signals of musical tones by accumulating the received frequency key-codes but requires no process of key-code/-frequency transformation which is performed in the above mentioned embodiments.

In the above mentioned embodiments, the open-string fret-position (the zero-fret position) is selected as the string-depression position in the preset mode but other arbitrary fret-position may be selected as the string-depressing position for examining the string state.

Although the combined method of the peak-point detecting method and the zero-cross point detecting method is employed in each embodiment for extracting pitches based on the detected peak points and zero-cross points, other pitch extracting method, for example, a method for detecting an interval between the maximum peak values can be employed.

Furthermore, the electronic tuning apparatus according to the present invention can be effectively used not only in the instruments illustrated in each embodiment, but also in such stringed instruments having the frets being aligned at random intervals for each string. In this case, the picking of each string at each fret is necessary in the initial setting operation. The present tuning apparatus is applicable to electronic stringed instrument having no fret and also to such electronic stringed instruments as an electronic violin, an electronic koto (a Japanese harp), an electronic harp, and so on.

The present electronic tuning apparatus is applicable not only to the electronic stringed instrument which employs the electro-magnetic method for picking up the string-vibration, but to an instrument which employs a piezoelectric device and/or an optical sensing device for picking up the string-vibration.

What is claimed is:

1. An electronic tuning apparatus for use in an electronic stringed instrument including a fingerboard, at least one string extended along said fingerboard, string-vibration detecting means for detecting the vibration of said string, pitch-extracting means for extracting the fundamental period from said string vibration detected b said string-vibration detecting means, and sound-generation start-instruction means for instructing start of a musical-tone generation when said string vibration exceeds a predetermined vibration level, said string vibration being detected by said string-vibration detecting means, the apparatus comprising:

reference-pitch information-setting means for setting as a reference-pitch information prior to performance the pitch information extracted by said pitch-extracting means, when the string is vibrated with its effective vibration length being defined by a predetermined reference string-depressing position; and sound frequency control means for converting to a performance-pitch information into a tuned sound-frequency designating data in accordance with said reference-pitch information set by said reference-pitch information setting means, when the string is vibrated with it effective vibration length being defined by an arbitrary string-depressing position selected out of many string-depressing positions to be manipulated during the performance 2. An apparatus of claim 1, wherein said reference-pitch information-setting means comprises extracted-pitch information storing means for storing prior to the performance the pitch information which is extracted by said pitch-extracting means, when the string is vibrated with its effective vibration length being defined by said predetermined reference string-depressing position; and reference-pitch information storing means for storing as the reference-pitch information the pitch information which are calculated for each of the string-depressing positions in accordance with the extracted pitch information stored in said extracted-pitch information storing means, and said sound-frequency control means comprises sound-frequency designating-data converting means for converting the performance-pitch information extracted by said pitch-extracting means into the tuned sound-frequency designating data in accordance with each reference-pitch information stored in said reference-pitch information storing means.

3. An apparatus of claim 1, wherein said sound-frequency control means comprises performance-pitch information-modifying calculation means for calculating to modify at real time the performance-pitch information extracted during the performance by said pitch-extracting means, based on said reference-pitch information set in the reference-pitch information setting means; and sound-frequency designating data converting means for converting into the tuned sound-frequency designating data, based on the modification result executed by said performance-pitch information-modifying calculation means.

4. An apparatus of claim 1, further comprising:

musical-tone generating means for generating a musical tone having the corresponding sound frequency in accordance with said sound-frequency designating data converted by the sound-frequency control means.

5. An apparatus of claim 1, further comprising:

manipulating means for changing the string-extended state of the string in response to string manipulation during the performance to alter the performance-pitch information extracted by said pitch extracting means to other performance-pitch information.

6. An apparatus of claim 1, wherein said predetermined reference string-depressing position corresponds to an open-string fret-position of the string.

7. An apparatus of claim 1, wherein said predetermined reference string-depressing position corresponds to said open-string fret-position and to at least one other position apart from said open-string fret-position by a predetermined distance.

8. An apparatus of claim 1, wherein said predetermined reference string-depressing position corresponds to at least one fret position among a plurality of fret positions provided on the fingerboard at uneven intervals therebetween which are defined in accordance with a twelve-temperament.

9. An apparatus of claim 1, wherein said predetermined reference string-depressing position corresponds to at least one of string-depressing position among a plurality of the fret positions which are aligned on the fingerboard at even interval therebetween.

10. An apparatus of claim 1, wherein said string-depressing positions correspond to a plurality of frets on the fingerboard.

11. An apparatus of claim 1, wherein said string-vibration detecting means selectively employs one of pick-up devices such as an electro-magnetic type pick-up device, a piezoelectric type pick-up device, and an optical sensing type pick-up device.

12. An apparatus of claim 1, wherein said string-vibration detecting means comprises an electro-magnetic type pick-up device and said string is made of non-magnetic material and is fixedly supported at both its ends, and a tube shaped member of magnetic material 6 provided on said string member at a position facing the electro-magnetic type pick-up device.

13. An electronic tuning apparatus for use in an electronic stringed instrument including a fingerboard, at least one string extended along said fingerboard, string-vibration detecting means for detecting the vibration of said string pitch extracting means for extracting the fundamental period data from said string vibration detected by said string-vibration detecting means, and sound-generation start-instruction means has instructed start of a musical-tone generation when said string vibration exceeds a predetermined vibration level, said string vibration being detected by said string-vibration detecting means, the apparatus comprising:

string-tension examining means for examining a string-tension state of said string, based on the fundamental period data which is extracted prior to performance by said pitch extracting means, when the string is vibrated with its effective vibration length defined by a predetermined string-depressing position;

initial sound-frequency control means for controlling so as to convert, when said sound-generation start-instruction means has instructed start of musical-tone generation, said fundamental period data extracted by said pitch extracting means into a corresponding tuned sound-frequency designating data in accordance with said string-tension state examined by said string-tension examining means; and after sound-frequency control means for controlling so as to convert, when other fundamental period data is extracted by said pitch extracting means after said sound-generation start-instruction means has instructed start of a musical-tone generation, said other fundamental period data into a corresponding tuned sound-frequency designating data in accordance with said string-tension state examined by said string-tension examining means.

14. An apparatus of claim 13, wherein said string-tension examining means comprises relationship prescribing means for defining a relationship between said arbitrary string-depressing position selected out of many string-depressing positions to be manipulated during performance and the corresponding fundamental period and for prescribing said string-tension state of the string based on said defined relationship, and said initial sound-frequency control means and said after sound-frequency control means comprise a first converting means for converting said fundamental period data extracted by said pitch extracting means into a corresponding string-depressing position data in accordance with the relationship defined by said relationship prescribing means, and a second converting means for converting said converted string-depressing position data supplied from said first converting means into the corresponding tuned sound-frequency designating data.

15. An apparatus of claim 13, wherein said string-tension examining means comprises ratio-calculation means for calculating a ratio of the fundamental period data to the tuned fundamental period data corresponding to said predetermined string depressing position, said fundamental period data being extracted by said pitch extracting means when the string is vibrated with said string being depressed at said predetermined string-depressing position, and said initial sound-frequency control means and said after sound-frequency control means comprise tuned period producing means for modifying the fundamental period data extracted by said pitch extracting means in accordance with the ratio calculated by said ratio-calculation means and for producing the tuned fundamental period data in accordance with said modified fundamental period data, and converting means for converting the tuned fundamental period data produced by said tuned period producing means into the corresponding sound-frequency designating data.

16. An apparatus of claim 13, wherein said string-tension examining means comprises relationship-prescribing means for defining the relationship between arbitrary string-depressing positions of said string and the corresponding fundamental periods in accordance with fundamental period data, and for prescribing the string-tension state of said string on the basis of the defined relationship, each of said fundamental period data being extracted by said pitch extracting means with respect to each of plurality of said string-depressing positions of said string.

17. An apparatus of claim 13, wherein said string-tension examining means comprises relationship-prescribing means for defining the relationship between arbitrary fundamental period data and the corresponding tuned fundamental period data in accordance with the fundamental period data which have been extracted by said pitch extracting means with respect to each of said string-depressing positions of said string, said arbitrary fundamental period data being to be extracted during performance by said pitch extracting means to be manipulated during the performance, and for prescribing the string-extended state of said string on the basis of said defined relationship.

18. An apparatus of claim 13, comprising:

wherein said initial sound-frequency control means comprises converting means for converting with a first resolution the fundamental period data extracted by said pitch extracting means into the corresponding tuned sound-frequency designating data, when said sound-generation start-instruction means instructs the start of sound-generation, and said after sound-frequency control means comprises converting means for converting with a second resolution the fundamental period data newly extracted by said pitch extracting means into the corresponding tuned sound-frequency designating data after said sound-generation start-instruction means has instructed the start of sound generation, said second r ®solution being higher than the first resolution.

19. An apparatus of claim 13, further comprising:

musical-tone generating means for generating a musical tone having the corresponding sound frequency in accordance with the sound-frequency designating data converted by said sound-frequency control means.

20. An apparatus of claim 13, further comprising:

manipulating means for changing the string-tension state of said string by its manipulation during performance and for converting the fundamental period data which has been extracted by said pitch extracting means into other fundamental period data in accordance with said changed string-tension state.

21. An apparatus of claim 13, wherein said predetermined string-depressing position corresponds to an open-string fret-position of said string.

22. An apparatus of claim 13, wherein said predetermined string-depressing position corresponds to a plurality of string-depressing positions including the open-string fret-position and at least one string-depressing position apart from said open-string fret position by a predetermined distance.

23. An apparatus of claim 13, wherein said predetermined string-depressing position corresponds to at least one of the string-depressing positions located on multiple frets aligned on said fingerboard at uneven intervals therebetween, which are defined by a twelvetemperament.

24. An apparatus of claim 13, wherein said predetermined string-depressing position corresponds to at least one of string-depressing positions located on multiple frets aligned on said fingerboard at even interval therebetween.

25. An apparatus of claim 14, wherein said string-depressing positions correspond to a plurality of frets on the fingerboard.

26. An apparatus of claim 13, wherein said string-vibration detecting means selectively employs one of pick-up devices such as an electro-magnetic type pick-up device, a piezoelectric type pick-up device, and an optical sensing type pick-up device.

27. An apparatus of claim 13, wherein said string-vibration detecting means comprises an electro-magnetic pick-up device and said string is made of non-magnetic material and is fixedly supported at both its ends, and a tube shaped member of magnetic material is provided on said string at a position facing said electro-magnetic pick-up device.

28. An apparatus of claim 13, wherein each of said initial sound-frequency control means and said after sound-frequency control means comprises key-code generating means for generating a key-code as said sound-frequency designating data in order to compress said sound-frequency designating data, said key-code being for expressing a sound frequency in a predetermined transform function of a period, and said key-code generating means comprises transform table means for storing data of said predetermined transform function; and means for generating a tuned key-code from the fundamental period data and the string-tension state with reference to the data of said predetermined transform function, which data are stored in said transform table means, said fundamental period data being extracted by said pitch extracting means, and said string-tension state being examined by said string-tension examining means.

29. An apparatus of claim 13, wherein each of said initial sound-frequency control means and said after sound-frequency control means comprises key-code generating means for generating a key-code as said sound-frequency designating data, said key-code being for expressing a sound frequency in a predetermined logarithm function of a period, and said key-code generating means comprises key-code calculating means for directly calculating a tuned key-code from the fundamental period data and the string-tension state, said fundamental period data being extracted by said pitch extracting means, and said string-tension state being examined by said string-tension examining means.

30. An apparatus of claim 13 wherein each of said initial sound-frequency control means and said after sound-frequency control means comprises key-code generating means for generating a key-code as said sound-frequency designating data, said key-code being for expressing a sound-frequency in the corresponding frequency, and said key-code generating means comprises means for generating a key-code which expresses a tuned frequency from the fundamental period data and the string-tension state, said fundamental period data being extracted by said pitch extracting means, and said string-tension state being examined by said string-tension examining means.

31. An electronic tuning apparatus comprising;

extracting means for detecting a vibration of at least one string which is extended with a predetermined string-length and for extracting pitch data from said detected string vibration;

memory means for previously storing said pitch data extracted by said extracting means as reference tuning pitch-data prior to musical performance; and converting means for converting performance pitch data into a corresponding sound-frequency designating information in accordance with said reference tuning pitch-data stored in said memory means, said performance pitch data being extracted from a string vibration by said extracting means, when said string is vibrated with an arbitrary string-length which is selected out of said predetermined string-length and a plurality of string-lengths being shorter than said predetermined string-length.

32. An apparatus of claim 31, further comprising musical-tone generating means for generating a musical-tone having a corresponding sound frequency in accordance with said sound-frequency designation information converted by said converting means when the vibration of said string is caused.

33. An electronic tuning apparatus comprising:

extracting means for detecting a vibration of at least one string which is extending with a predetermined string-length and for extracting pitch data from said detected string vibration;

first memory means for previously storing said pitch data as a first reference pitch-data prior to performance, said pitch data being extracted from a string vibration by said extracting means when said string is vibrated with said predetermined string-length;

second memory means for previously storing a corresponding second reference pitch data prior to performance for each of a plurality of other string-lengths which are shorter than said predetermined string-length, on the basis of said first reference pitch-data stored in said first memory means; and converting means for converting performance pitch-data extracted during the performance into a corresponding sound-frequency designating information in accordance with said each sound reference pitch-data which has been stored in said second memory and corresponds to a selected string-length, said performance pitch data being extracted by said extracting means, when said string is vibrated with an arbitrary string-length which is selected out of said predetermined string-length and plurality of said other string-lengths.

34. An apparatus of claim 33, further comprising musical-tone generating means for generating a musical tone having a corresponding sound frequency in accordance with said sound-frequency designation information converted by said converting means when the vibration of said string is caused.

35. An electronic tuning apparatus comprising:

extracting means for detecting a vibration of at least one string extended with a predetermined string-length and for extracting pitch data from said detected string vibration;

memory means for previously storing prior to performance said pitch data extracted by said extracting means as reference pitch-data when said string is vibrated with said predetermined string-length; and converting means for converting performance pitch data extracted during the performance into a corresponding sound-frequency designating information in accordance with the reference pitch-data stored in said memory means, said performance pitch data being extracted by said extracting means when said string is vibrated with a selected arbitrary string length out of said predetermined string-length and a plurality of string lengths which are shorter than said predetermined string-length.

36. An apparatus of claim 35, further comprising musical-tone generating means for generating a musical-tone having a corresponding sound frequency in accordance with said sound frequency designation information converted by said converting means when the vibration of said string is caused.

37. An electronic tuning apparatus comprising:

extracting means for detecting a vibration of at least one string extended with a predetermined string length and for extracting pitch data from said detected string vibration;

memory means for previously storing prior to performance the pitch data extracted by said extracting means as a first reference pitch-data when said string is vibrated when said predetermined string length and for previously storing prior to performance the pitch data extracted by said extracting means as a second reference pitch-data when said string is vibrated with a string-length differing from said predetermined string-length; and converting means for converting performance pitch data into a corresponding sound-frequency designating information in accordance with both of said first and second reference pitch-data stored in said memory means, said performance pitch data being extracted by said extracting means when said string vibrated with an arbitrary string-length selected by a player.

38. An apparatus of claim 37, further comprising musical-tone generating means for generating a musical-tone having a corresponding sound frequency in accordance with said sound frequency designation information converted by said converting means when the vibration of said string is caused.

39. An electronic tuning apparatus comprising;

extracting means for detecting a vibration of at least one string extended with a predetermined pitch length and for extracting pitch data from said detected string vibration.

memory means for previously storing prior to performance reference pitch-data corresponding to said predetermined string-length and corresponding to a plurality of other string-lengths which are shorter than said predetermined string-length on the basis of the pitch data extracted by said extracting means when said string is vibrated for each of said other string-lengths; and converting means for converting performance pitch data into a corresponding sound-frequency designating information in accordance with the reference pitch-data corresponding to a selected string-length, which reference pitch-data is selected out of said reference pitch-data stored in said memory means, said performance pitch data being extracted by said extracting means when said string is vibrated with an arbitrary selected string-length out of said predetermined string-length and a plurality of said other string-lengths.

40. An apparatus of claim 39, further comprising musical-tone generating means for generating a musical-tone having a corresponding sound frequency in accordance with said sound-frequency designation information converted by said converted means when the vibration of said string is caused.

41. An electronic tuning apparatus comprising:

extracting means for detecting a vibration of at least one string extended with a predetermined string-length and for extracting pitch data from said detected string vibration;

prescribing means for prescribing mutual relationship prior to performance between pitch data and a plurality of other string-lengths which are shorter than said predetermined string-length, said pitch data being extracted by said extracting means when said string is vibrated when said predetermined string-length; and converting means for converting a performance pitch-data into a corresponding sound-frequency designating information in accordance with the mutual relationship prescribed by said prescribing means, said performance pitch data being extracted by said extracting means when said string is vibrated with an arbitrary selected string-length out of a plurality of said other string-lengths during the performance.

42. An apparatus of claim 41, further comprising musical-tone generating means for generating a musical-tone having a corresponding sound frequency in accordance with said sound-frequency designation information converting by said converting means when the vibration of said string is caused.

43. An electronic tuning apparatus comprising:

extracting means for detecting a vibration of at least one string extended with a predetermined string-length and for extracting pitch data from said detected string vibration;

memory means for previously storing prior to performance a first reference pitch data corresponding to said predetermined string-length and a second reference pitch data corresponding to a plurality of other string-lengths which are shorter than said predetermined string-length on the basis of said pitch data extracted by said extracting means; and converting means for converting an arbitrary pitch data extracted by said extracting means when said string is vibrated with an arbitrary selected string-length out of said predetermined string-length and a plurality of said other string-lengths into a sound-frequency designating information in accordance with the pitch data corresponding to said selected string-length, which pitch data is selected by a player out of said first and second reference pitch-data stored in said memory means.

44. An apparatus of claim 43, further comprising musical-tone generating means for generating a musical-tone having a corresponding sound frequency in accordance with said sound-frequency designation information converted by said converting means when the vibration of said string is caused.

45. An electronic tuning apparatus for a stringed instrument, comprising:

extracting means for extracting a fundamental period data of a string vibration which is supplied thereto;

measuring means for measuring a tension state of said string based on the fundamental period data which is extracted by said extracting means prior to a musical performance; and converting means for converting said fundamental period data which is extracted during the musical performance by said extracting means into a corresponding tuned tone pitch data in accordance with said tension state measured by said measuring means.

46. An electronic tuning apparatus for a stringed instrument, comprising:

extracting means for extracting a pitch data from a string-vibration, said pitch data corresponding to the string vibration;

setting means for setting reference pitch data for a plurality of string-depressing positions to be manipulated based on the pitch data which is extracted by said extracting means prior to a musical performance; and converting means for converting a pitch data corresponding to an arbitrary selected string-depressing position during musical performance out of said string-depressing positions into a tuned pitch data based on said reference pitch data, said tuned pitch data corresponding to said selected string-depressing position.

47. The apparatus of claim 46, wherein said plurality of string-depressing positions correspond respectively to an open string fret position and to a plurality of fret positions.

* * * * *

UNITED STATES PATENT AND TRADEMARK OFFICE

CERTIFICATE OF CORRECTION

PATENT NO. : 4,928,563

DATED : May 29, 1990

INVENTOR(S) : MURATA ET AL

It is certified that error appears in the above-identified patent and that said Letters Patent is hereby corrected as shown below:

Column 34, line 68 (claim 1), following "performance", insert --.--.

Column 36, line 8 (claim 12), change "6" before "provided", to --is--.

Column 36, line 17 (claim 13), change "has instructed" to --for instructing--.

Column 37, line 40 (claim 18), delete "comprising:"

Column 37, line 55 (claim 18), change "r®solution" to --resolution--.

Signed and Sealed this

Twelfth Day of May, 1992

*Attest:*

*Attesting Officer*

DOUGLAS B. COMER

*Acting Commissioner of Patents and Trademarks*